US011003118B2

(12) United States Patent
Yoshida et al.

(10) Patent No.: US 11,003,118 B2
(45) Date of Patent: May 11, 2021

(54) FIXING APPARATUS AND IMAGE FORMING APPARATUS THAT CONTROL HEAT GENERATION OF HEAT GENERATION MEMBERS

(71) Applicant: CANON KABUSHIKI KAISHA, Tokyo (JP)

(72) Inventors: Tsuguhiro Yoshida, Yokohama (JP); Kazuhiro Doda, Yokohama (JP); Hiroto Endo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/781,109

(22) Filed: Feb. 4, 2020

(65) Prior Publication Data

US 2020/0249600 A1 Aug. 6, 2020

(30) Foreign Application Priority Data

Feb. 6, 2019 (JP) ..... JP2019-019912

(51) Int. Cl.
*G03G 15/20* (2006.01)
*G03G 15/00* (2006.01)

(52) U.S. Cl.
CPC ..... *G03G 15/2042* (2013.01); *G03G 15/2039* (2013.01); *G03G 15/2053* (2013.01); *G03G 15/2064* (2013.01); *G03G 15/5004* (2013.01)

(58) Field of Classification Search
CPC ..... G03G 15/2039; G03G 15/2053; G03G 15/2064; G03G 15/2042; G03G 15/2046; G03G 2215/00464; G03G 2215/00468; G03G 2215/00472
USPC ..... 399/45, 69, 334
See application file for complete search history.

(56) References Cited

U.S. PATENT DOCUMENTS 6,580,883 B2 6/2003 Suzumi
2011/0164890 A1* 7/2011 Ota ..... G03G 15/2042 399/43
2019/0163100 A1* 5/2019 Wakatsu ..... G03G 15/205

FOREIGN PATENT DOCUMENTS

JP 05181375 A * 7/1993
JP 08220930 A * 8/1996
JP 2000-235326 A 8/2000
JP 2001-100558 A 4/2001
(Continued)

OTHER PUBLICATIONS

Co-pending U.S. Appl. No. 16/744,669, filed Jan. 16, 2020.
Co-pending U.S. Appl. No. 16/746,063, filed Jan. 17, 2020.
Co-pending U.S. Appl. No. 16/822,426, filed Mar. 18, 2020.

*Primary Examiner* — Robert B Beatty
(74) *Attorney, Agent, or Firm* — Venable LLP

(57) ABSTRACT

The fixing apparatus includes a first heat generation member to fix an image on a first recording material or a second recording material whose length in a longitudinal direction is shorter than a length in a longitudinal direction of the first recording material, and a second heat generation member whose length in a longitudinal direction is shorter than a length in a longitudinal direction of the first heat generation member, the second heat generation member configured to fix an image on the second recording material, wherein the fixing apparatus performs a first operation in which the second heat generation member generates heat for a certain period while a first rotary member and a second rotary member rotate after the completion of printing on sheets of the second recording material.

20 Claims, 14 Drawing Sheets

(56) References Cited

FOREIGN PATENT DOCUMENTS

| | | | | |
|---|---|---|---|---|
| JP | 2002-162847 | A | | 6/2002 |
| JP | 6053887 | B2 | | 12/2016 |
| JP | 2019020482 | A | * | 2/2019 |

* cited by examiner

FIXING APPARATUS AND IMAGE FORMING APPARATUS THAT CONTROL HEAT GENERATION OF HEAT GENERATION MEMBERS

BACKGROUND OF THE INVENTION

Field of the Invention

The present invention relates to a fixing apparatus in an electrophotographic image forming apparatus such as a copier or a printer, and to an image forming apparatus having the fixing apparatus.

Description of the Related Art

Some of conventional image forming apparatuses include a fixing apparatus that includes multiple heat generation members of different lengths. For example, Japanese Patent Application Laid-Open No. 2001-100558 discloses a configuration in which a heat generation member to be powered is exclusively switched with a switching relay, so that a heat generation member whose length corresponds to the sheet size is selectively used to prevent a temperature increase in non-sheet passing portions. A temperature increase in non-sheet passing portions refers to a phenomenon of an increase in temperature in non-sheet passing portions while fixing is performed on sheets P of a width shorter than the longitudinal length of the heat generation member. The non-sheet passing portions are where the heat generation member does not contact the sheets P.

In the configuration in which a heat generation member to be powered is selected with a switching relay, it is desirable to switch the contact of the switching relay after cutting off the power supplied to the heater in order to avoid contact sticking of the switching relay. However, if the heat generation member is switched during printing, the temperature of components of the fixing apparatus decreases during the switching of the heat generation member. To address this, in continuous printing, the heat generation member may be switched in the interval between sheets (hereinafter referred to as a sheet interval). This can reduce the influence of the power cutoff during the switching of the heat generation member. In a fixing apparatus or an image forming apparatus having multiple heat generation members of different lengths, selecting a heat generation member corresponding to the width of the recording material can reduce the temperature increase in the non-sheet passing portions.

In printing on a narrower recording material, fixing can be performed by heating the recording material with a narrower heat generation member if the fixing apparatus is sufficiently heated (warmed up). However, if the fixing apparatus is not sufficiently heated, a wider heat generation member may need to be used even for fixing on the narrower recording material from the viewpoint of preventing deformation of a fixing film. Assume that fixing is performed on a wider recording material immediately after fixing is performed on the narrower recording material with the wider heat generation member. Hot offset may then occur in the areas of the non-sheet passing portions where the narrower recording material just subjected to the fixing did not pass through.

SUMMARY OF THE INVENTION

An aspect of the present invention is a fixing apparatus including a first heat generation member configured to fix an image on a first recording material or a second recording material whose length in a longitudinal direction is shorter than a length in a longitudinal direction of the first recording material, a second heat generation member whose length in a longitudinal direction is shorter than a length in a longitudinal direction of the first heat generation member, the second heat generation member configured to fix an image on the second recording material, a first rotary member configured to be heated by the first heat generation member or the second heat generation member, a second rotary member configured to form a nip portion together with the first rotary member, and a control unit in a case of continuous printing on a plurality of sheets of the second recording material, configured to control fixing to be performed with the first heat generation member at a predetermined frequency, wherein in a state where the first rotary member and the second rotary member rotate after completion of printing on the plurality of sheets of the second recording material, the control unit performs a first operation in which the second heat generation member generates heat.

Another aspect of the present invention is an image forming apparatus including an image forming unit configured to form an unfixed toner image on a recording material; and a fixing apparatus configured to fix the unfixed toner image on the recording material, wherein the fixing apparatus including a first heat generation member configured to fix an image on a first recording material or a second recording material whose length in a longitudinal direction is shorter than a length in a longitudinal direction of the first recording material, a second heat generation member whose length in a longitudinal direction is shorter than a length in a longitudinal direction of the first heat generation member, the second heat generation member configured to fix an image on the second recording material, a first rotary member configured to be heated by the first heat generation member or the second heat generation member, a second rotary member configured to form a nip portion together with the first rotary member, and a control unit in a case of continuous printing on a plurality of sheets of the second recording material, configured to control fixing to be performed with the first heat generation member at a predetermined frequency, wherein in a state where the first rotary member and the second rotary member rotate after completion of printing on the plurality of sheets of the second recording material, the control unit performs a first operation in which the second heat generation member generates heat.

Further features of the present invention will become apparent from the following description of exemplary embodiments with reference to the attached drawings.

DESCRIPTION OF THE EMBODIMENTS

Embodiments of the present invention will be described below with reference to the drawings. In the following embodiments, passing a recording sheet through a fixing nip portion will be expressed as feeding a sheet. Areas where a heat generation member is generating heat but no recording sheet is being fed will be referred to as non-sheet passing areas (or non-sheet passing portions). An area where a heat generation member is generating heat and a recording sheet is being fed will be referred to as a sheet passing area (or a sheet passing portion). Further, a phenomenon in which the non-sheet passing areas have a higher temperature than the sheet passing area will be referred to as a temperature increase in the non-sheet passing portions.

First Embodiment

[General Configuration]

Figure 1:
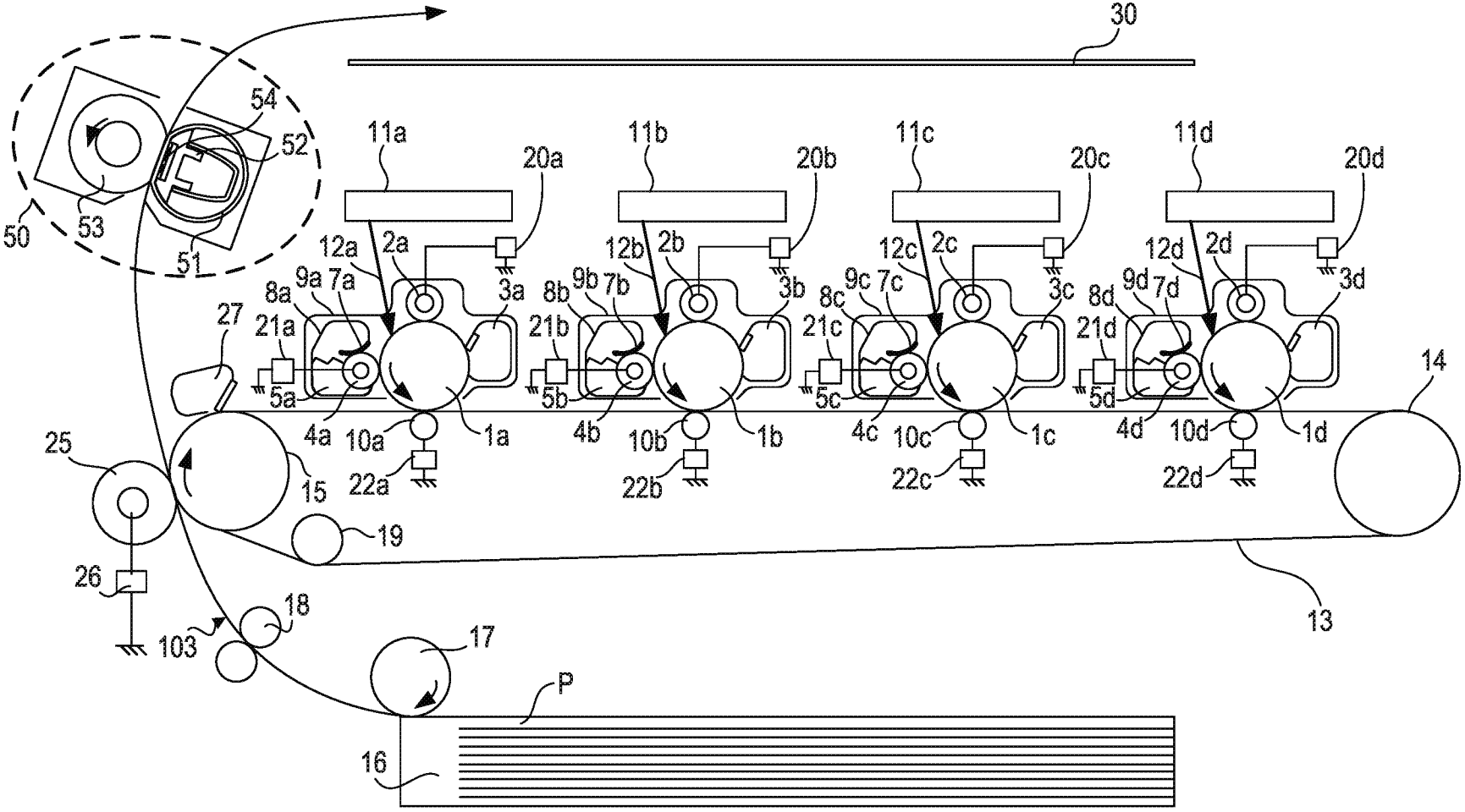
FIG. 1 is a configuration diagram of an image forming apparatus in first to third embodiments.

FIG. 1 is a configuration diagram illustrating an in-line color image forming apparatus, which is an exemplary image forming apparatus having a fixing apparatus in a first embodiment. Operations of the electrophotographic color image forming apparatus will be described with reference to FIG. 1. First, second, third and fourth stations are stations for forming toner images in yellow (Y), magenta (M), cyan (C) and black (K), respectively.

In the first station, a photosensitive drum 1*a* serving as an image carrier is an OPC photosensitive drum. The photosensitive drum 1*a* has multiple layers of functional organic materials formed on a metal cylinder, including a carrier generation layer that generates electric charge when exposed to light, and a charge transport layer that transports the generated electric charge. The outermost layer has low electric conductivity and is substantially insulating. A charge roller 2*a* serving as a charge unit is in contact with the photosensitive drum 1*a*. As the photosensitive drum 1*a* rotates, the charge roller 2*a* is driven to rotate and uniformly charges the surface of the photosensitive drum 1*a*. A direct-current voltage, or a direct-current voltage on which an alternating-current voltage is superimposed, is applied to the charge roller 2*a*. The photosensitive drum 1*a* is charged by the occurrence of discharge in small air gaps upstream and downstream in the rotation direction from a nip portion between the charge roller 2*a* and the surface of the photosensitive drum 1*a*. A cleaning unit 3*a* cleans off toner remaining on the photosensitive drum 1*a* after transfer to be described below. A development unit 8*a* includes a development roller 4*a*, nonmagnetic single-component toner 5*a*, and a developer application blade 7*a*. The photosensitive drum 1*a*, the charge roller 2*a*, the cleaning unit 3*a*, and the development unit 8*a* constitute an integrated process cartridge 9*a* detachable from the image forming apparatus.

An exposure device 11*a* serving as an exposure unit includes a scanner unit performing scan with laser light via a polygon mirror, or includes an LED (light-emitting diode) array. The exposure device 11*a* irradiates the photosensitive drum 1*a* with a scanning beam 12*a* modulated according to an image signal. The charge roller 2*a* is connected to a high-voltage power supply for charge 20*a*, which is a unit for supplying voltage to the charge roller 2*a*. The development roller 4*a* is connected to a high-voltage power supply for development 21*a*, which is a unit for supplying voltage to the development roller 4*a*. A primary transfer roller 10*a* is connected to a high-voltage power supply for primary transfer 22*a*, which is a unit for supplying voltage to the primary transfer roller 10*a*. The first station is configured as described above, and so are the second, third, and fourth stations. For the second, third, and fourth stations, components having the same functions as in the first station are labeled with the same numerals followed by indexes b, c, and d for the respective stations. In the following description, the indexes a, b, c and d will be omitted except in the cases of describing any specific station.

An intermediate transfer belt 13 is supported by three rollers serving as its stretching members: a secondary transfer counter roller 15, a tension roller 14, and an auxiliary roller 19. Force in the direction of stretching the intermediate transfer belt 13 is applied only to the tension roller 14 by a spring, so that appropriate tension force is maintained on the intermediate transfer belt 13. The secondary transfer counter roller 15 is driven to rotate by a main motor (not shown), thereby rotating the intermediate transfer belt 13 wound around the periphery. The intermediate transfer belt 13 moves in the forward direction (for example, the clockwise direction in FIG. 1) at the substantially same speed as the photosensitive drums 1*a* to 1*d* (which rotate in, for example, the counterclockwise direction in FIG. 1). While the intermediate transfer belt 13 rotates in the direction of the arrow (the clockwise direction), the primary transfer roller 10, disposed opposite to the photosensitive drum 1 with the intermediate transfer belt 13 in between, is driven to rotate with the movement of the intermediate transfer belt 13. The position where the photosensitive drum 1 and the primary transfer roller 10 abut on each other with the intermediate transfer belt 13 in between will be referred to as a primary transfer position. The auxiliary roller 19, the tension roller 14, and the secondary transfer counter roller 15 are electrically grounded. The primary transfer rollers 10*b* to 10*d* in the second to fourth stations have a similar configuration to the configuration of the primary transfer roller 10*a* in the first station and therefore will not be described.

Image forming operations (printing) of the image forming apparatus in the first embodiment will now be described. Upon receiving a print command in a standby state, the image forming apparatus starts image forming operations. Components such as the photosensitive drums 1 and the intermediate transfer belt 13 start to be rotated by the main motor (not shown) in the directions of the arrows at a predetermined process speed. The charge roller 2*a* with voltage applied by the high-voltage power supply for charge 20*a* uniformly charges the photosensitive drum 1*a*. The scanning beam 12*a* emitted by the exposure device 11*a* then forms an electrostatic latent image according to image information (also referred to as image data). The toner 5*a* in the development unit 8*a* is negatively charged by the developer application blade 7*a* and applied to the development roller 4*a*. The development roller 4*a* receives a predetermined development voltage supplied by the high-voltage power supply for development 21*a*. As the photosensitive drum 1*a* rotates, the electrostatic latent image formed on the photosensitive drum 1*a* reaches the development roller 4*a*. The negatively charged toner attaches to the electrostatic latent image, which is then visualized to form a toner image in a first color (for example, Y (yellow)) on the photosensitive drum 1*a*. The stations of the other colors M (magenta), C (cyan) and K (black) (the process cartridges 9*b* to 9*d*) also operate in a similar manner. Electrostatic latent images are formed by exposure on the respective photosensitive drums 1*a* to 1*d* while write signals from a controller (not shown) are delayed by a certain time corresponding to the distance between the primary transfer positions for the respective colors. A direct-current high voltage with the polarity opposite to the polarity of the toner is applied to the primary transfer rollers 10*a* to 10*d*. Through the above process, the toner images are sequentially transferred onto the intermediate transfer belt 13 (hereinafter referred to as primary transfer), resulting in a multilayer toner image formed on the intermediate transfer belt 13.

Thereafter, timed to the formation of the toner image, a sheet P serving as a recording material and stacked in a cassette 16 is fed (picked up) by a sheet feed roller 17 driven to rotate by a sheet feed solenoid (not shown). The fed sheet P is conveyed by a conveyance roller to registration rollers 18. A registration sensor 103 is disposed downstream from the registration rollers 18. The registration sensor 103 detects the presence of the sheet P upon arrival of the leading edge of the sheet P and detects the absence of the sheet P upon passage of the trailing edge of the sheet P. In synchronization with the toner image on the intermediate transfer belt 13, the sheet P is conveyed by the registration rollers 18 to a transfer nip portion, which is a contact portion between the intermediate transfer belt 13 and a secondary transfer roller 25. A voltage with the polarity opposite to the polarity of the toners is applied to the secondary transfer roller 25 by a high-voltage power supply for secondary transfer 26. The four-color multilayer toner image carried on the intermediate transfer belt 13 is collectively transferred onto the sheet P (the recording material) (hereinafter referred to as secondary transfer). The components (for example, the photosensitive drums 1) that contribute to the formation of the unfixed toner image on the sheet P function as an image forming unit. After the secondary transfer, toner remaining on the intermediate transfer belt 13 is cleaned off by the cleaning unit 27. The sheet P after the secondary transfer is conveyed to a fixing apparatus 50 serving as a fixing unit, in which the toner image is fixed onto the sheet P. The sheet P is ejected as an image-formed product (a printed sheet or a copy) onto an ejection tray 30. It takes approximately 9 seconds for the sheet P to reach the fixing nip portion and approximately 12 seconds for the sheet P to be ejected after the start of the image forming operations. A film 51, a nip forming member 52, a pressure roller 53, and a heater 54 in the fixing apparatus 50 will be described below.

The print mode in which images are continuously printed on multiple sheets P will hereinafter be referred to as continuous printing or a continuous job. In continuous printing, a sheet interval refers to the interval between the trailing edge of a sheet P (hereinafter referred to as a preceding sheet) printed earlier and the leading edge of a sheet P (hereinafter referred to as a following sheet) to be printed following the preceding sheet. In continuous printing in the first embodiment, the sheets P and toner images on the intermediate transfer belt 13 are synchronously conveyed with a sheet interval of 30 mm, for example, and printing is performed. The image forming apparatus in the first embodiment is a center-aligned image forming apparatus, so that print operations are performed by aligning the center positions of components and of the sheets P in the direction (the longitudinal direction to be described below) orthogonal to the conveyance direction. Therefore, the center position of the sheets P during print operations is fixed whether the sheets P are wider or narrower in the direction orthogonal to the conveyance direction.

[Block Diagram of Image Forming Apparatus]

Figure 2:
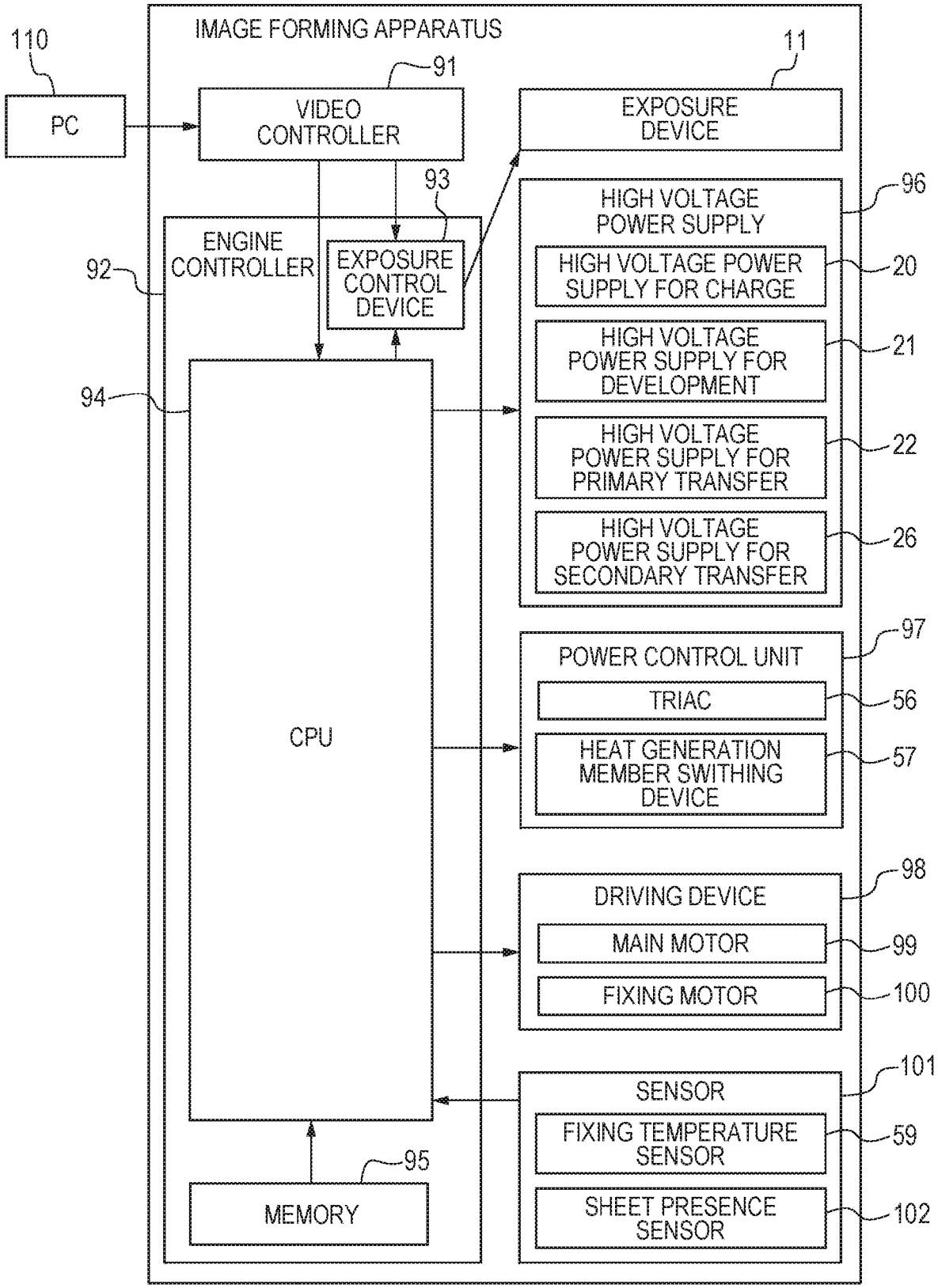
FIG. 2 is a block diagram of the image forming apparatus in the first to third embodiments.

FIG. 2 is a block diagram for describing operations of the image forming apparatus. With reference to FIG. 2, print operations of the image forming apparatus will be described. A PC 110 serving as a host computer is responsible for issuing a print command to a video controller 91 in the image forming apparatus and transferring image data about a print image to the video controller 91.

The video controller 91 converts the image data received from the PC 110 into exposure data and transfers the exposure data to an exposure control devices 93 in an engine controller 92. The exposure control devices 93 is controlled by a CPU 94 to switch on/off the exposure data and to control the exposure devices 11. The CPU 94 serving as a control unit starts an image forming sequence upon receiving the print command.

The engine controller 92 includes the CPU 94 and a memory 95, and performs preprogrammed operations. A high-voltage power supply 96 includes the above-described high-voltage power supplies for charge 20, high-voltage power supplies for development 21, high-voltage power supplies for primary transfer 22, and high-voltage power supply for secondary transfer 26. A power control unit 97 includes a bidirectional thyristor (hereinafter referred to as a triac) 56 and a heat generation member switching device 57. The heat generation member switching device 57 serving as a switching unit switches between heat generation members by switching the power supply path used for supplying power. The power control unit 97 selects a heat generation member that is to generate heat in the fixing apparatus 50, and determines the amount of power to be supplied. In the first embodiment, the heat generation member switching device 57 is a Form C contact relay, for example. A driving device 98 includes a main motor 99 and a fixing motor 100. Sensors 101 include a fixing temperature sensor 59 that detects the temperature of the fixing apparatus 50, and a sheet presence sensor 102 that has a flag and detects the presence or absence of a sheet P. The detection results of the sensors 101 are sent to the CPU 94. The sheet presence sensor 102 may include the registration sensor 103. The CPU 94 obtains the detection results of the sensors 101 in the image forming apparatus and controls the exposure devices 11, the high-voltage power supply 96, the power control unit 97, and the driving device 98. The CPU 94 thus forms an electrostatic latent image, transfers a developed toner image, and fixes the toner image onto a sheet P, for example, thereby controlling the image forming process in which exposed data is printed as a toner image on a sheet P. Image forming apparatuses to which the present invention is applicable are not limited to those configured as described in FIG. 1, but may be any image forming apparatus that can print on sheets P of different widths and that has the fixing apparatus 50 with the heater 54 to be described below.

[Fixing Apparatus]

Figure 3:
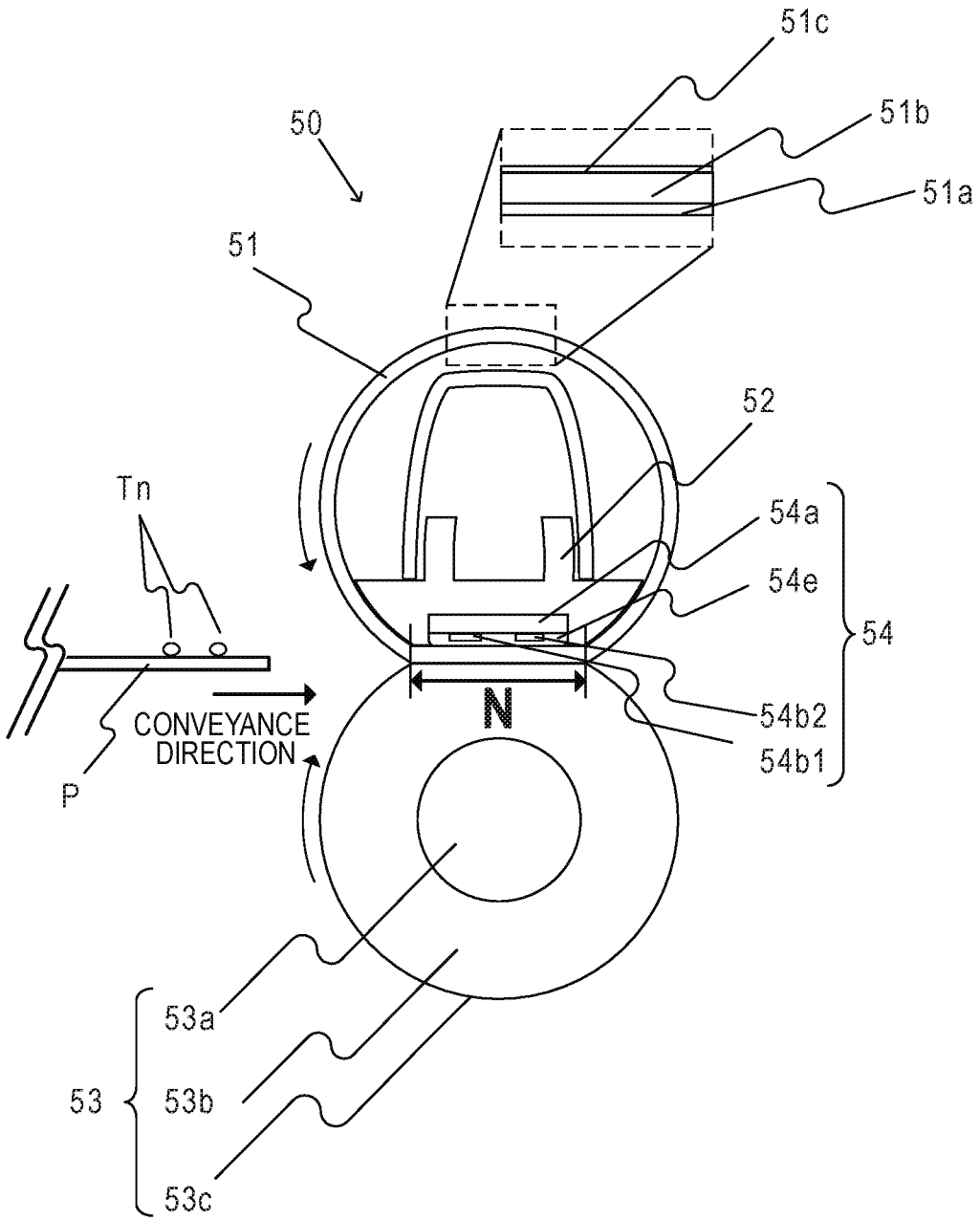
FIG. 3 is a schematic sectional view of the longitudinal center area of a fixing apparatus in the first to third embodiments.

The configuration of the fixing apparatus 50 in the first embodiment will be described with reference to FIG. 3. A longitudinal direction refers to the direction in which the rotation axis of the pressure roller 53 extends substantially orthogonally to the conveyance direction of the sheets P to be described below. A width refers to the length of a sheet P or a heat generation member in the direction (the longitudinal direction) substantially orthogonal to the conveyance direction. FIG. 3 is a schematic sectional view of the fixing apparatus 50.

In FIG. 3, a sheet P bearing an unfixed toner image Tn is conveyed from the left toward the right. The sheet P is heated in the nip portion (hereinafter referred to as a fixing nip portion N), resulting in the toner image Tn fixed onto the sheet P. The fixing apparatus 50 in the first embodiment includes: the cylindrical film 51; the nip forming member 52 that holds the film 51; the pressure roller 53 that forms the fixing nip portion N together with the film 51; and the heater 54 for heating the sheets P.

The film 51, which is a first rotary member, is a fixing film serving as a heating rotary member. In the first embodiment, the film 51 includes three layers: a base layer 51*a*, an elastic layer 51*b*, and a release layer 51*c*. The base layer 51*a* is made of polyimide, for example. On the base layer 51*a* are the elastic layer 51*b* made of silicone rubber and the release layer 51*c* made of PFA. The base layer 51*a* has a thickness of 50 μm, the elastic layer 51*b* has a thickness of 200 μm, and the release layer 51*c* has a thickness of 20 μm. The film 51 has an outside diameter of 18 mm. The perimeter of the film 51 will be denoted as a perimeter M. Grease is applied to the inner surface of the film 51 in order to reduce friction force produced on the film 51 against the nip forming member 52 and the heater 54 due to the rotation of the film 51.

The nip forming member 52 is responsible for internally guiding the film 51 and for forming the fixing nip portion N together with the pressure roller 53, with the film 51 in between. The nip forming member 52 has rigidity, heat resistance and heat insulation, and is formed of a material such as a liquid crystal polymer. The film 51 is fitted onto the nip forming member 52. The pressure roller 53, which is a second rotary member, is a roller serving as a pressure rotary member. The pressure roller 53 includes a metal core 53*a* made of steel, an elastic layer 53*b* made of silicone rubber, and a release layer 53*c* made of a PFA material. The metal core 53*a* has a diameter of 12 mm, for example. The elastic layer 53*b* has a thickness of 3 mm, for example. The release layer 53*c* has a thickness of 50 μm, for example. The pressure roller 53 has a diameter (an outside diameter) of 20 mm, for example. The perimeter of the pressure roller 53 will be denoted as a perimeter K. The pressure roller 53 is rotatably held at both ends and is driven to rotate by the fixing motor 100 (see FIG. 2). With the rotation of the pressure roller 53, the film 51 is rotated. The heater 54 serving as a heating member is held by the nip forming member 52 to be in contact with the inner surface of the film 51. A substrate 54*a*, heat generation members 54*b*1 and 54*b*2, and a protective glass layer 54*e* will be described below.

(Heater)

Figure 4A:
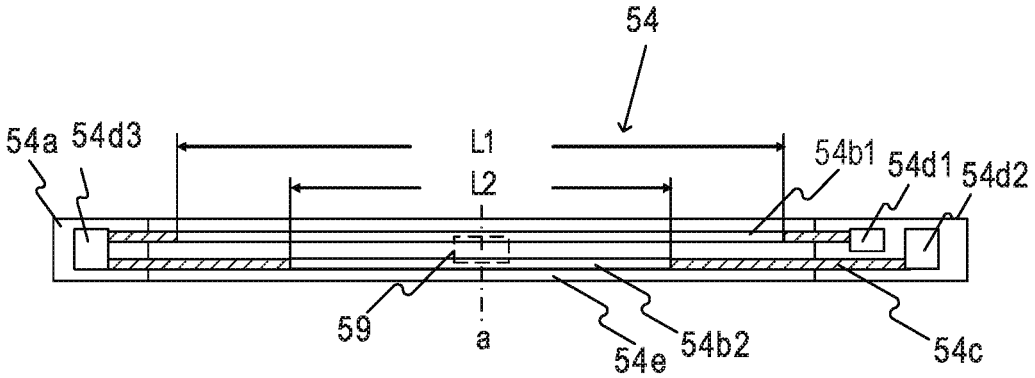
FIGS. 4A, 4B and 4C are schematic diagrams of a heater in the first to third embodiments and a schematic diagram of a power control circuit in the first and third embodiments.
Figure 4B:
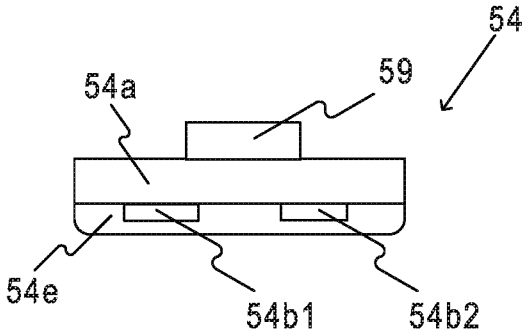

The heater 54 will be described in detail with reference to FIGS. 4A and 4B. The heater 54 includes the substrate 54*a* made of alumina, the heat generation members 54*b*1 and 54*b*2 made of silver paste, a conductor 54*c*, contacts 54*d*1 to 54*d*3, and the protective glass layer 54*e* made of glass. The heat generation members 54*b*1 and 54*b*2, the conductor 54*c*, and the contacts 54*d*1 to 54*d*3 are formed on the substrate 54*a*. The protective glass layer 54*e* is further formed on these components to ensure insulation between the film 51 and the heat generation members 54*b*1 and 54*b*2. The heat generation members 54*b*1 and 54*b*2 may be collectively referred to as heat generation members 54*b*. The substrate 54*a* has a length (a longitudinal length) of 250 mm, a width (a lateral length) of 7 mm, and a thickness of 1 mm, for example. The heat generation members 54*b* and the conductor 54*c* have a thickness of 10 μm, for example. The contacts 54*d* has a thickness of 20 μm, for example. The protective glass layer 54*e* has a thickness of 50 μm, for example.

The heat generation member 54*b*1 serving as a first heat generation member and the heat generation member 54*b*2 serving as a second heat generation member are different in longitudinal length (hereinafter also referred to as size). The heater 54 in the first embodiment has at least the heat generation members 54*b*1 and 54*b*2. Specifically, the heat generation member 54*b*1 has the longitudinal length L1 and the heat generation member 54*b*2 has the longitudinal length L2, and the lengths L1 and L2 are in the relationship of L1>L2. The longitudinal length L1 of the heat generation member 54*b*1 is so that L1=222 mm, for example. The longitudinal length L2 of the heat generation member 54*b*2 is so that L2=185 mm, for example. The heat generation member 54*b*1 is electrically connected to the contacts 54*d*1 and 54*d*3 via the conductor 54*c*. The heat generation member 54*b*2 is electrically connected to the contacts 54*d*2 and 54*d*3 via the conductor 54*c*. That is, the contact 54*d*3 is a shared contact connected to both heat generation members 54*b*1 and 54*b*2.

The fixing temperature sensor 59 is located on a surface of the substrate 54*a* opposite to the protective glass layer 54*e*. The fixing temperature sensor 59 is provided at the longitudinal center "a" (a dashed and single-dotted line) of the heat generation members 54*b*1 and 54*b*2 and pressed against the substrate 54*a* at 200 gf (gram weight). The fixing temperature sensor 59 is a thermistor, for example, and detects the temperature of the heater 54 and outputs the detection result to the CPU 94. The temperature detected by the fixing temperature sensor 59 correlates with the temperature of the fixing nip portion N, and specifically with the temperature of the pressure roller 53. The detection result of the fixing temperature sensor 59 can therefore be regarded as the temperature of the fixing nip portion N (the pressure roller 53). Based on the detection result of the fixing temperature sensor 59, the CPU 94 controls the temperature so that the temperature during fixing becomes a target temperature (a fixing temperature). In the first embodiment, the power control unit 97 controls the temperature of the fixing apparatus 50 to be 180° C., for example.

(Power Control Unit)

Figure 4C:
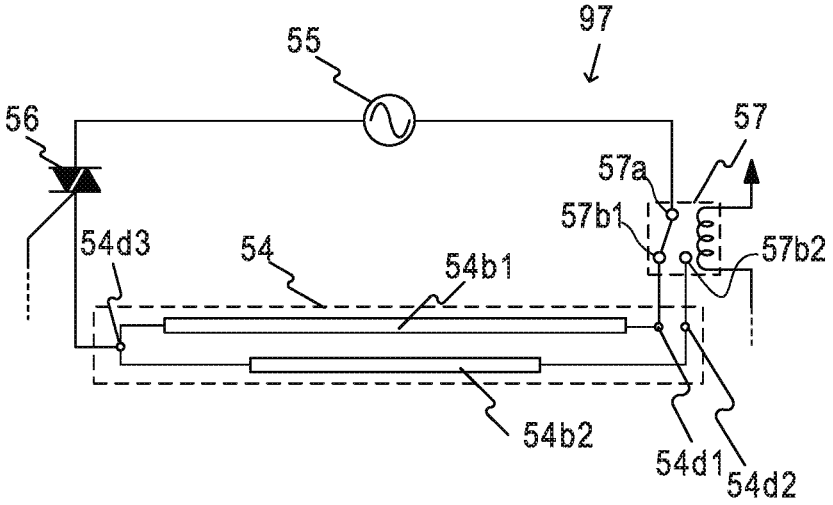

FIG. 4C is a schematic diagram of the power control unit 97 serving as a control circuit of the fixing apparatus 50. The power control unit 97 of the fixing apparatus 50 includes the heat generation members 54*b*1 and 54*b*2 (the heater 54), an AC power supply 55, the triac 56, and the heat generation member switching device 57. The triac 56 is brought into conduction (turned on) when supplying power from the AC power supply 55 to the heat generation member 54*b*1 or 54*b*2 through a power supply path. The triac 56 is brought out of conduction (turned off) when cutting off the power supply from the AC power supply 55 to the heat generation member 54*b*1 or 54*b*2. The triac 56 functions as a connection unit that supplies (in a connecting state) or cuts off (in a disconnecting state) power to the heater 54. Based on the temperature information detected by the fixing temperature sensor 59, the CPU 94 calculates the power necessary for controlling the temperature of the heat generation member 54*b*1 or 54*b*2 to be the target temperature (for example, 180° C. as mentioned above) and controls the triac 56 to be in conduction or out of conduction.

The heat generation member switching device 57 in the first embodiment is a Form C contact relay, for example. Specifically, the heat generation member switching device 57 has a contact 57*a* connected to the AC power supply 55, a contact 57*b*1 connected to the contact 54*d*1, and a contact 57*b*2 connected to the contact 54*d*2. Under the control of the CPU 94, the heat generation member switching device 57 assumes either one of the state in which the contact 57*a* is connected to the contact 57*b*1 and the state in which the contact 57*a* is connected to the contact 57*b*2. The switching of the heat generation member switching device 57 causes the power supply path to be switched to either one of the power supply path for supplying power to the heat generation member 54*b*1 and the power supply path for supplying power to the heat generation member 54*b*2. This exclusively determines which of the heat generation members 54*b*1 and 54*b*2 is powered. That is, the heat generation member switching device 57 switches the heater 54 between the heat generation members 54*b*1 and 54*b*2. Hereinafter, switching the power supply path by the heat generation member switching device 57 will also be expressed as switching to (or selecting) the heat generation member 54*b*1 or 54*b*2. The heat generation member switching device 57 performs the switching in response to receiving a signal from the CPU 94. For preventing contact sticking of the heat generation member switching device 57 that is a Form C contact relay, the switching by the heat generation member switching device 57 is performed while the triac 56 is out of conduction (while power supply to the heat generation member 54*b*1 or 54*b*2 is cut off). In the first embodiment, it takes 200 ms for the heat generation member switching device 57 to complete switching after the CPU 94 outputs a switching signal.

Here, a sheet P having a width shorter than the width of the heat generation member 54*b*2 will be referred to as a small-size sheet, which is a second recording material. A sheet P having a width longer than the width of the heat generation member 54*b*2 will be referred to as a large-size sheet, which is a first recording material. In printing on large-size sheets, fixing uses the heat generation member 54*b*1. In printing on small-size sheets, fixing uses the heat generation member 54*b*1 and the heat generation member 54*b*2 alternately switched at a predetermined frequency depending on the number of printed sheets from the viewpoint of preventing deformation of the film 51. In the first embodiment, the operation of switching between the heat generation members 54*b* is performed during continuous printing on small-size sheets, for example.

[Continuous Printing on Large-Size Sheets and Continuous Printing on Small-Size Sheets]

Figure 5:
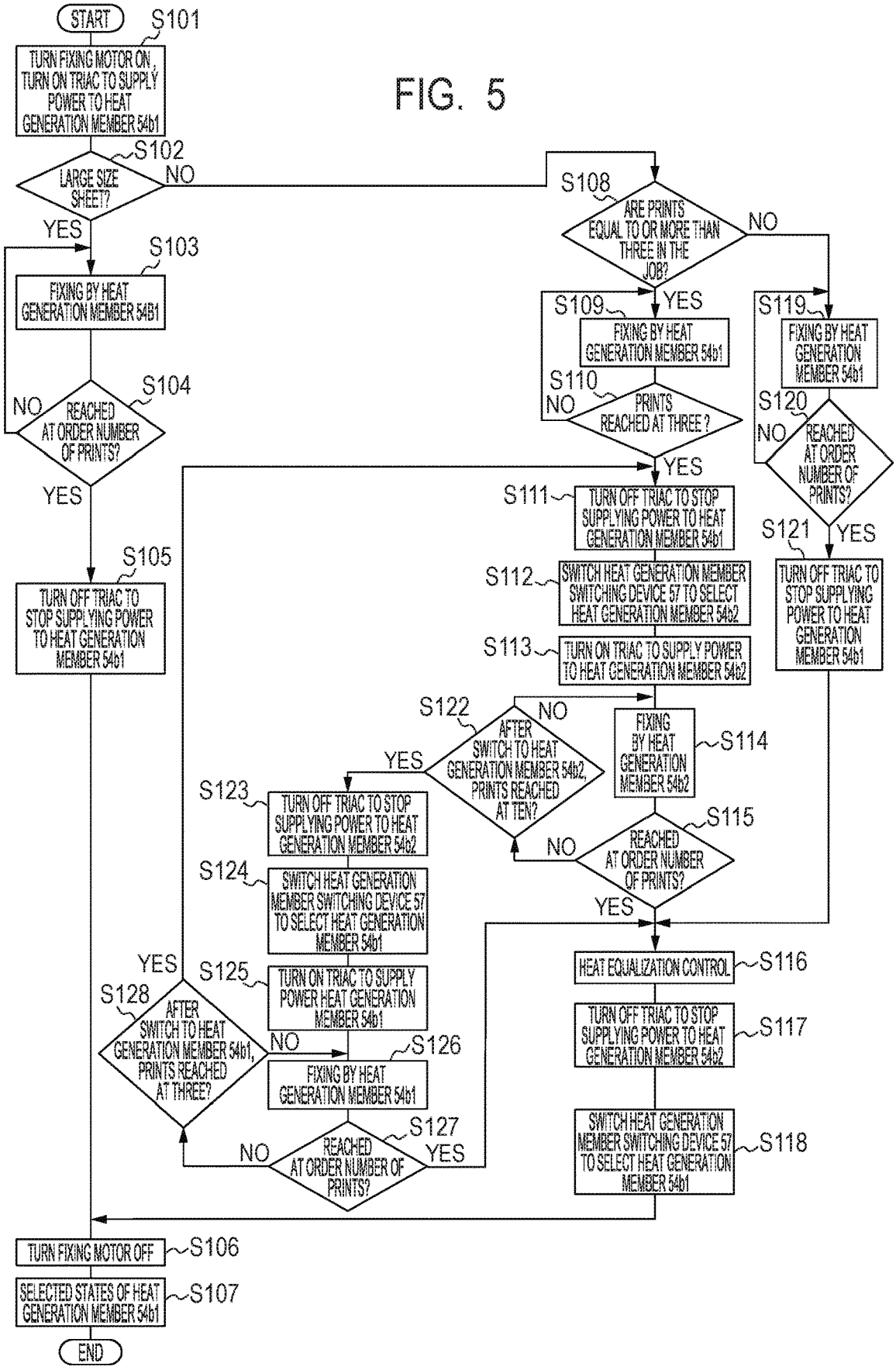
FIG. 5 is a flowchart of control for switching between heat generation members in the first to third embodiments.

Exemplary cases of continuous printing on large-size sheets and continuous printing on small-size sheets will be described with reference to FIG. 5. FIG. 5 is a flowchart illustrating the control of switching between the heat generation members 54*b* in the first embodiment. In the first embodiment, in the end of print operations, the heat generation member switching device 57 is used to switch to the state capable of supplying power to the heat generation member 54*b*1 having the longest width, irrespective of the width of the sheets P, and the printing is terminated. Therefore, whenever print operations are started, the heat generation member 54*b*1 is already selected by the heat generation member switching device 57 and is ready to generate heat.

First, as an operation common to continuous printing on large-size sheets and continuous printing on small-size sheets, the CPU 94 starts a process beginning at step (hereinafter denoted as S) 101 upon receiving a print instruction (a print command). As described above, when the CPU 94 receives the print instruction, the power supply path is already switched by the heat generation member switching device 57 so that power is supplied to the heat generation member 54*b*1. At S101, the CPU 94 activates (turns on) the fixing motor 100 to start rotation of the pressure roller 53, and causes the triac 56 to start (turn on) power supply to the heat generation member 54*b*1 of the heater 54. This causes the film 51 to be heated while being driven to rotate. At S102, the CPU 94 determines whether the sheets P to be printed are large-size sheets. If the CPU 94 determines that the sheets P to be printed are large-size sheets at S102, the process proceeds to S103. At S103, the CPU 94 performs fixing with the heat generation member 54*b*1. That is, when continuous printing on large-size sheets is started, the heat generation member 54*b* is not switched.

At S104, the CPU 94 determines whether the number of printed sheets P has reached the number specified by the print instruction (the specified number of sheets to be printed). The CPU 94 has a counter (not shown) that counts the number of printed sheets, and manages the number of printed sheets with the counter. If the CPU 94 determines that the specified number of sheets to be printed has not been reached at S104, the process returns to S103.

If the CPU 94 determines that the sheets P to be printed are not large-size sheets but small-size sheets at S102, the process proceeds to S108. At S108, the CPU 94 determines whether the received print job specifies printing on three or more sheets P. If the CPU 94 determines that the received print job specifies printing on three or more sheets P at S108, the process proceeds to S109. At S109, the CPU 94 performs fixing with the heat generation member 54*b*1. At S110, the CPU 94 determines whether the number of printed sheets has reached three. If the CPU 94 determines that the number of printed sheets has not reached three at S110, the process returns to S109. If the CPU 94 determines that the number of printed sheets has reached three at S110, the process proceeds to S111.

At S111, the CPU 94 causes the triac 56 to cut off (turn off) the power supply to the heat generation member 54*b*1. At S112, the CPU 94 causes the heat generation member switching device 57 to switch the power supply path so that power is supplied to the heat generation member 54*b*2 (select the heat generation member 54*b*2). At S113, the CPU 94 causes the triac 56 to start (turn on) power supply to the heat generation member 54*b*2. That is, if continuous printing is performed on three or more small-size sheets, the heat generation member 54*b*1 is used for the first three (a predetermined number of) sheets P. Between the third sheet P and the fourth sheet P, the heat generation member 54*b* is switched from the heat generation member 54*b*1 to the heat generation member 54*b*2. In this manner, irrespective of the size of the sheets P, the fixing operation is performed with the heat generation member 54*b*1 for the first several (the predetermined number of) sheets (in the above example, the first three sheets). The reason for cutting off the power supply by the triac 56 here is to prevent contact sticking of the heat generation member switching device 57 that is a Form C contact relay.

(Film Deformation)

As above, the fixing is performed with the wider heat generation member **54*b*1 for the first several sheets even if the sheets are small-size sheets. This is for uniformly transferring heat across the longitudinal direction of the fixing nip portion N to uniformly soften the grease on the inner surface of the film 51, thereby preventing deformation of the film 51**.

The reason why the film 51 may be deformed will be described in detail. If the fixing operation is performed with the narrower heat generation member **54*b*2 while the fixing apparatus 50 is still cold, a difference in grease viscosity arises between the longitudinally inner area and the longitudinally outer areas of the heat generation member 54*b*2. This applies twisting force to the film 51, which may then be deformed. In the longitudinal area where the heat generation member 54*b*2 exists in the fixing nip portion N, the temperature increases due to the power supplied to the heat generation member 54*b*2. This reduces the grease viscosity, so that the sliding load between the film 51 and the heater 54 decreases. By contrast, in the longitudinal areas where not the heat generation member 54*b*2 but only the heat generation member 54*b*1 exists in the fixing nip portion N, the temperature in the fixing nip portion N does not significantly increase while power is being supplied to the heat generation member 54*b*2. This causes the grease viscosity to be maintained high, so that the sliding load does not decrease and remains high. Consequently, force is applied to the film 51 when the film 51 is driven to rotate by the pressure roller 53. This force causes a difference in the rotation speed of the film 51 between the longitudinal center portion where the heat generation member 54*b*2 exists and both longitudinal edge portions where the heat generation member 54*b*2 does not exist. If the film 51 is not sufficiently strong, the film 51 may be twisted and deformed. With the configuration in the first embodiment, fixing in continuous printing for small-size sheets uses the heat generation member 54*b*1 for the first three sheets and the heat generation member 54*b*2 for the fourth and following sheets. With this configuration, deformation of the film 51** was not observed.

Returning to the description of FIG. 5, if the sheets are large-size sheets, fixing in the printing on all the sheets P is performed with the heat generation member **54*b*1 in the processing up to S104. If the CPU 94 determines that the specified number of sheets to be printed has been reached at S104, the process proceeds to S105. After finishing the printing, at S105, the CPU 94 causes the triac 56 to cut off (turn off) the power supply to the heat generation member 54*b*1. At S106, the CPU 94 stops (turns off) the fixing motor 100. At S107, the CPU 94 causes the heat generation member switching device 57 to select the heat generation member 54*b*1** and terminates the process.

If the sheets are small-size sheets and if the CPU 94 determines that the specified number of sheets to be printed is less than three at S108, the process proceeds to S119. At S119, the CPU 94 performs fixing with the heat generation member **54*b*1. At S120, the CPU 94 determines whether the specified number of sheets to be printed (i.e., the number less than three) has been reached. If the CPU 94 determines that the specified number of sheets to be printed has not been reached at S120, the process returns to S119. If the CPU 94 determines that the specified number of sheets to be printed has been reached at S120, the process proceeds to S121. Thus, if the specified number of sheets to be printed is less than three, fixing on all the sheets are performed with the heat generation member 54*b*1 irrespective of the width of the sheets P. After finishing the printing, at S121, the CPU 94 causes the triac 56 to cut off (turn off) the power supply to the heat generation member 54*b*1, and the process proceeds to S116**.

Processing for the fourth and following sheets in the case of printing on three or more small-size sheets will be described. At S114, the CPU 94 performs fixing on the sheet P with the heat generation member **54*b*2. At S115, the CPU 94 determines whether the specified number of sheets to be printed has been reached. If the CPU 94 determines that the specified number of sheets to be printed has not been reached at S115, the process proceeds to S122. If the CPU 94 determines that the specified number of sheets to be printed has been reached at S115, the process proceeds to S116. At S116, the CPU 94 performs heat equalization control. The heat equalization control will be described below. At S117, the CPU 94 causes the triac 56 to cut off (turn off) the power supply to the heat generation member 54*b*2. At S118, the CPU 94 causes the heat generation member switching device 57 to switch the power supply path so that power is supplied to the heat generation member 54*b*1 (select the heat generation member 54*b*1), and the process proceeds to S106. The processing at S117 and S118 in the first embodiment is performed during, for example, a postprocessing operation (hereinafter also referred to as post-rotation) of the fixing apparatus 50 in which the fixing motor 100** is still driven after the completion of the printing.

In the first embodiment, the distance between sheets (the sheet interval) is 30 mm in continuous printing that does not involve switching the heat generation member **54*b*. The sheet interval is 30 mm also in continuous printing that involves switching the heat generation member 54*b*. With the process speed in the first embodiment, the time 300 ms corresponding to the sheet-interval distance is longer than the switching time 200 ms of the Form C contact relay. Therefore, the sheet interval does not need to be extended. For an image forming apparatus with a faster process speed or a shorter sheet interval, the sheet interval may need to be extended for switching the heat generation member 54*b***.

At S122, the CPU 94 determines whether the number of printed sheets after switching to the heat generation member **54*b*2 has reached 10. If the CPU 94 determines that the number of printed sheets has not reached 10 at S122, the process returns to S114. That is, if the number of printed sheets after switching to the heat generation member 54*b*2 is less than 10, fixing is performed on the sheets P still with the heat generation member 54*b*2. If the CPU 94 determines that the number of printed sheets has reached 10 at S122, the process proceeds to S123**.

At S123, the CPU 94 causes the triac 56 to cut off (turn off) the power supply to the heat generation member **54*b*2. At S124, the CPU 94 causes the heat generation member switching device 57 to switch the power supply path so that power is supplied to the heat generation member 54*b*1 (select the heat generation member 54*b*1). At S125, the CPU 94 causes the triac 56 to start (turn on) power supply to the heat generation member 54*b*1. At S126, the CPU 94 performs fixing with the heat generation member 54*b*1**.

At S127, the CPU 94 determines whether the number of sheets to be printed specified by the print instruction has been reached. If the CPU 94 determines that the specified number of sheets to be printed has not been reached at S127, the process proceeds to S128. At S128, the CPU 94 determines whether the number of printed sheets after switching to the heat generation member **54*b*1 has reached three. If the CPU 94 determines that the number of printed sheets has not reached three at S128, the process returns to S126. If the CPU 94 determines that the number of printed sheets has reached three at S128, the process returns to S111**.

In this manner, if 10 or more sheets P are printed, control is repeated so that fixing is performed on 10 sheets P with the heat generation member 54*b*2 and then on 3 sheets P with the heat generation member 54*b*1. That is, the CPU 94 controls fixing to be performed on small-size sheets with the heat generation member 54*b*2 but also with the heat generation member 54*b*1 at a predetermined frequency. In FIG. 5, fixing is performed on 10 small-size sheets with the heat generation member 54*b*2 and then on 3 small-size sheets with the heat generation member 54*b*1. However, the numbers of sheets are not limited to these values. The values are determined according to factors such as the relationship among the number of small-size sheets subjected to fixing with the heat generation member 54*b*1, the number of small-size sheets subjected to fixing with the heat generation member 54*b*2, and the difference in temperature between the longitudinal center portion and the longitudinal edge portions of the fixing nip portion N. If the CPU 94 determines that the specified number of sheets to be printed has been reached at S127, the process proceeds to S116.

[Heat Equalization Control]

The heat equalization control at S116 in FIG. 5 will be described below. The first embodiment is characterized in that an operation is performed for reducing the longitudinal temperature nonuniformity of the fixing members resulting after the completion of printing on small-size sheets; this is done by causing the heat generation member 54*b*2 to generate heat according to the temperature nonuniformity during the post-rotation after the completion of the printing. Hereinafter, the operation of reducing the temperature nonuniformity will be referred to as a heat equalization operation, which is a first operation. The heat equalization control at S116 is also performed during the post-rotation of the fixing apparatus 50 in which the fixing motor 100 is still rotating after the completion of the printing.

Figure 6:
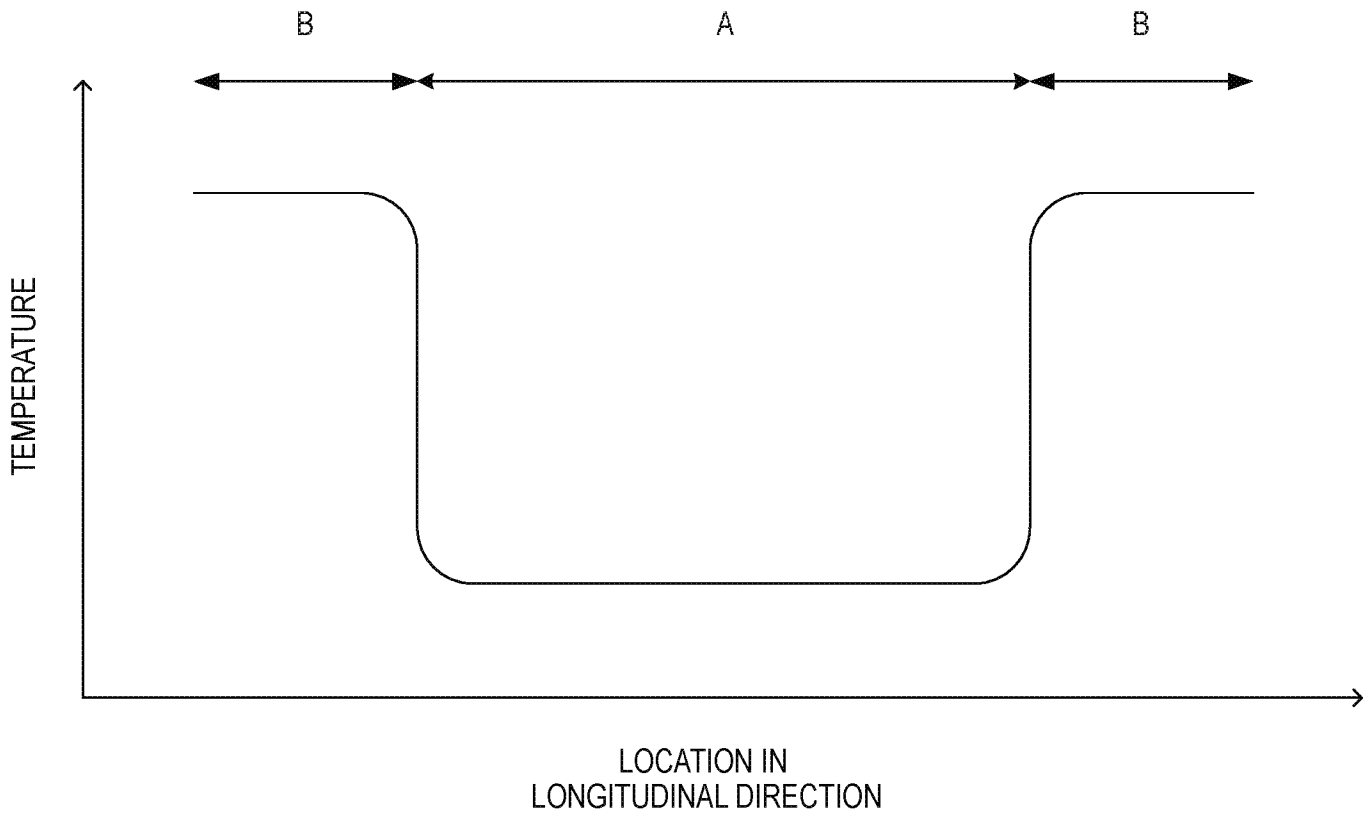
FIG. 6 is a graph illustrating a temperature distribution in the longitudinal direction of a fixing nip portion in the first to third embodiments.

Details of the heat equalization operation in the heat equalization control at S116 will be described with reference to FIG. 6. FIG. 6 is a graph illustrating a longitudinal temperature distribution (temperature profile) along the pressure roller 53 according to the configuration in the first embodiment. This temperature distribution is observed when fixing is performed on a small-size sheet while the heat generation member 54*b*1 is generating heat. In FIG. 6, the abscissa indicates the location in the longitudinal direction on the pressure roller 53 (the location in the longitudinal direction), and the ordinate indicates the temperature. Since the heat generation member 54*b*1 is selected, the fixing nip portion N is heated by the heat generation member 54*b*1 across the entire sheet passing area. The area labeled with A in FIG. 6 (hereinafter referred to as an area A) is an area through which the small-size sheet (for example, a B5 sheet) is fed. Because the heat in the area A is carried away along with the sheet P, the temperature of the pressure roller 53 is low in the area A. By contrast, in the areas labeled with B on both sides of the area A (hereinafter referred to as areas B), the temperature of the pressure roller 53 is high after the small-size sheet is fed while the heat generation member 54*b*1 is selected. This is observed at the start of print operations on small-size sheets or in the middle of the continuous printing on the small-size sheets, as in the first embodiment.

As above, the temperature in both edge portions of the pressure roller 53 is high after printing on small-size sheets. If a large-size sheet such as a letter-size or A4 sheet is fed immediately after the completion of the printing on the small-size sheets, image degradation may occur. Specifically, hot offset may occur on the large-size sheet. Hot offset is a phenomenon as follows. The large heat capacity of the pressure roller 53 causes excessive toner to be melted in the high-temperature portions of the pressure roller 53 on both sides of the sheet passing area for small-size sheets. The melted toner adheres to the film 51, and after another rotation of the film 51, is transferred onto the sheet P.

The heat equalization operation that characterizes the first embodiment is the operation of reducing the longitudinal temperature nonuniformity of the film 51 and the pressure roller 53 as in FIG. 6 resulting after printing on small-size sheets. The temperature nonuniformity is so that the temperature in the area A is lower than the temperature in the areas B. Specifically, this operation includes heating only the area A colder than the areas B by causing the heat generation member 54*b*2 to generate heat after the completion of print operations (during the above-described post-rotation).

The duration of the heat equalization operation is determined by predicting how much the temperature of the pressure roller 53 increases in the areas of the non-sheet passing portions for small-size sheets (the heating state or the degree of temperature increase) from the number of printed sheets. The heat equalization operation is performed for a period corresponding to an integral multiple of the time (hereinafter referred to as one cycle) required for one rotation of the pressure roller 53. Specifically, the degree of temperature increase of the pressure roller 53 in the areas of the non-sheet passing portions for small-size sheets is represented as an edge thermal index. Based on the edge thermal index, the duration of the heat equalization operation is determined.

[Counting Edge Thermal Index]

Figure 7:
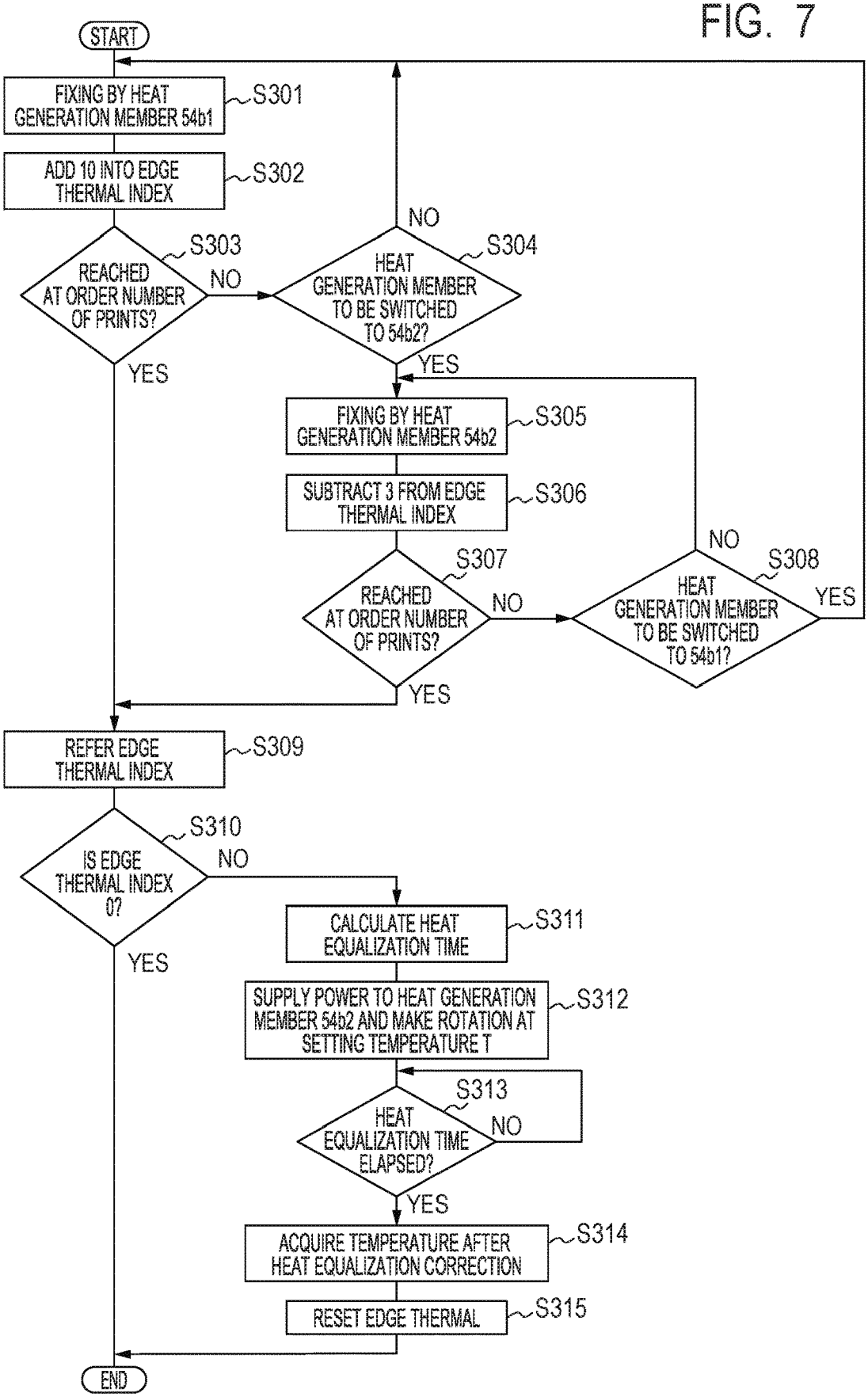
FIG. 7 is a flowchart of heat equalization control in the first embodiment.

FIG. 7 is a flowchart for describing the method of counting the edge thermal index in printing on small-size sheets. Upon starting print operations on sheets including small-size sheets, the CPU 94 performs a process beginning at S301. At S301, the CPU 94 performs fixing with the heat generation member 54*b*1. At S302, the CPU 94 adds, for example, 10 to the edge thermal index WI (WI=WI+10). At S303, the CPU 94 determines whether the number of sheets to be printed specified by a print instruction has been reached. If the CPU 94 determines that the specified number of sheets to be printed has not been reached at S303, the process proceeds to S304. At S304, the CPU 94 determines whether to switch to the heat generation member 54*b*2. If the CPU 94 determines not to switch to the heat generation member 54*b*2 at S304, the process returns to S301. In this manner, during continuous printing on small-size sheets, the CPU 94 adds 10 to the edge thermal index each time fixing is performed on a small-size sheet with the heat generation member 54*b*1.

If the CPU 94 determines to switch to the heat generation member 54*b*2 at S304, the process proceeds to S305. At S305, the CPU 94 performs fixing with the heat generation member 54*b*2. At S306, the CPU 94 subtracts, for example, 3 from the edge thermal index WI (WI=WI−3). At S307, the CPU 94 determines whether the specified number of sheets to be printed has been reached. If the CPU 94 determines that the specified number of sheets to be printed has not been reached at S307, the process proceeds to S308. At S308, the CPU 94 determines whether to switch to the heat generation member 54*b*1. If the CPU 94 determines not to switch to the heat generation member 54*b*1 at S308, the process returns to S305. In this manner, during continuous printing on small-size sheets, the CPU 94 subtracts 3 from the edge thermal index each time fixing is performed with the heat generation member 54b2 after the heat generation member 54b is switched from the heat generation member 54b1 to the heat generation member 54b2.

If the CPU 94 determines to switch to the heat generation member 54b1 at S308, the process returns to S301. If the CPU 94 determines that the specified number of sheets to be printed has been reached at S303 or S307, the process proceeds to S309. At S309, the CPU 94 refers to the edge thermal index WI. At S310, the CPU 94 determines whether the edge thermal index WI referred to at S309 is 0. If the CPU 94 determines that the edge thermal index WI is 0 at S309, the process terminates. If the CPU 94 determines that the edge thermal index WI is not 0 at S309, the process proceeds to S311.

At S311, according to the edge thermal index WI referred to at S309, the CPU 94 acquires the heat equalization time (sec), which is a certain period, illustrated in Table 1 to be described below. At S312, the CPU 94 causes the heat generation member 54b2 to generate heat for the heat equalization time acquired at S311. If this heat equalization control is performed after the processing at S127 (YES) or S121 in FIG. 5, the CPU 94 switches the heat generation member 54b to the heat generation member 54b2 before the heat equalization control. The CPU 94 has a timer (not shown) and manages the elapsed time from the start of supplying power to the heat generation member 54b2. Further, in this heat equalization operation, the CPU 94 controls the temperature while causing the heat generation member 54b2 to generate heat. That is, while rotating the pressure roller 53 with no sheets P being fed (hereinafter referred to as idling), the CPU 94 controls the temperature so that the fixing temperature sensor 59 senses a specified set temperature T.

At S313, the CPU 94 refers to the timer to determine whether the heat equalization time acquired at S311 has elapsed. If the CPU 94 determines that the heat equalization time has not elapsed at S313, the process returns to S313. If the CPU 94 determines that the heat equalization time has elapsed at S313, the process proceeds to S314. At S314, the CPU 94 acquires a "correction temperature after heat equalization," which is determined from the edge thermal index WI and Table 1. The correction temperature after heat equalization will be described below. At S315, the CPU 94 initializes the edge thermal index WI (clears to 0) and terminates the process.

In counting the edge thermal index WI in the first embodiment, 10 is added to the edge thermal index WI for each use of the heat generation member 54b1, and 3 is subtracted from the edge thermal index WI for each use of the heat generation member 54b2. However, the values to be added and subtracted may be any other values that correspond to the widths of the heat generation members 54b1 and 54b2 or the widths of the large-size sheets and the small-size sheets.

During the heat equalization operation, the CPU 94 controls the temperature so that the fixing temperature sensor 59 senses a fixed temperature, for example 150° C., as the set temperature T. In print operations immediately after the above-described heat equalization operation, the target temperature of the temperature control for the fixing apparatus 50 is reduced from the temperature that would be the target in the absence of the heat equalization operation. This is shown as the correction temperature after heat equalization in Table 1. The heat equalization operation is the operation of reducing the longitudinal temperature nonuniformity by relatively increasing the temperature in the longitudinal center portion of the pressure roller 53. Therefore, after the heat equalization operation, the temperature of the entire pressure roller 53 is higher than the temperature that would be observed in the absence of the heat equalization operation. To address this, after the heat equalization operation, the target temperature for the fixing apparatus 50 is corrected by reducing the target temperature by the correction temperature after heat equalization. Fixing using the correction temperature after heat equalization is performed for, for example, two minutes after the completion of the heat equalization operation.

TABLE 1

| | EDGE THERMAL INDEX | | | |
|---|---|---|---|---|
| | 1-5 | 6-10 | 11-20 | 21-30 |
| HEAT EQUALIZATION TIME (SEC) | 0 | 0.65 | 1.3 | 1.9 |
| CORRECTION TEMPERATURE AFTER HEAT EQUALIZATION (° C.) | 0 | −3 | −6 | −9 |

Table 1 illustrates the edge thermal index, the heat equalization time (sec), and the correction temperature after heat equalization (° C.). For example, assume that counting the edge thermal index WI in FIG. 7 results in an edge thermal index WI of 7 referred to at S309. The CPU 94 then refers to Table 1 to acquire 0.65 seconds as the heat equalization time (S311). The CPU 94 also refers to Table 1 to reduce the temperature for the temperature control after the heat equalization control by 3° C. from the temperature for the temperature control before the heat equalization control (S314). As shown in Table 1, as the edge thermal index WI increases, the area A in FIG. 5 is colder relative to the areas B, and therefore the heat equalization time is set to be longer and the range of reduction of the correction temperature after heat equalization is increased.

When the heat generation member 54b1 is being used, the entire fixing nip portion (or pressure roller 53) is heated in both the center portion and the edge portions. Therefore, the temperature difference between the center portion and the edge portions is small. By contrast, when the heat generation member 54b2 is being used, the longitudinal center portion of the fixing nip portion N is heated but not the edge portions. The temperature in the edge portions therefore decreases due to natural heat dissipation. Consequently, continuous use of the heat generation member 54b2 increases the temperature difference between the longitudinal center portion and the longitudinal edge portions of the fixing nip portion N. The edge thermal index can be said to be an index that represents the degree to which the edge portions of the fixing nip portion N (or the pressure roller 53) are heated; this degree is based on the temperature increase in the edge portions resulting from the use of the heat generation member 54b1, and the temperature decrease in the edge portions resulting from the use of the heat generation member 54b2.

<Advantageous Effect>

Figure 8:
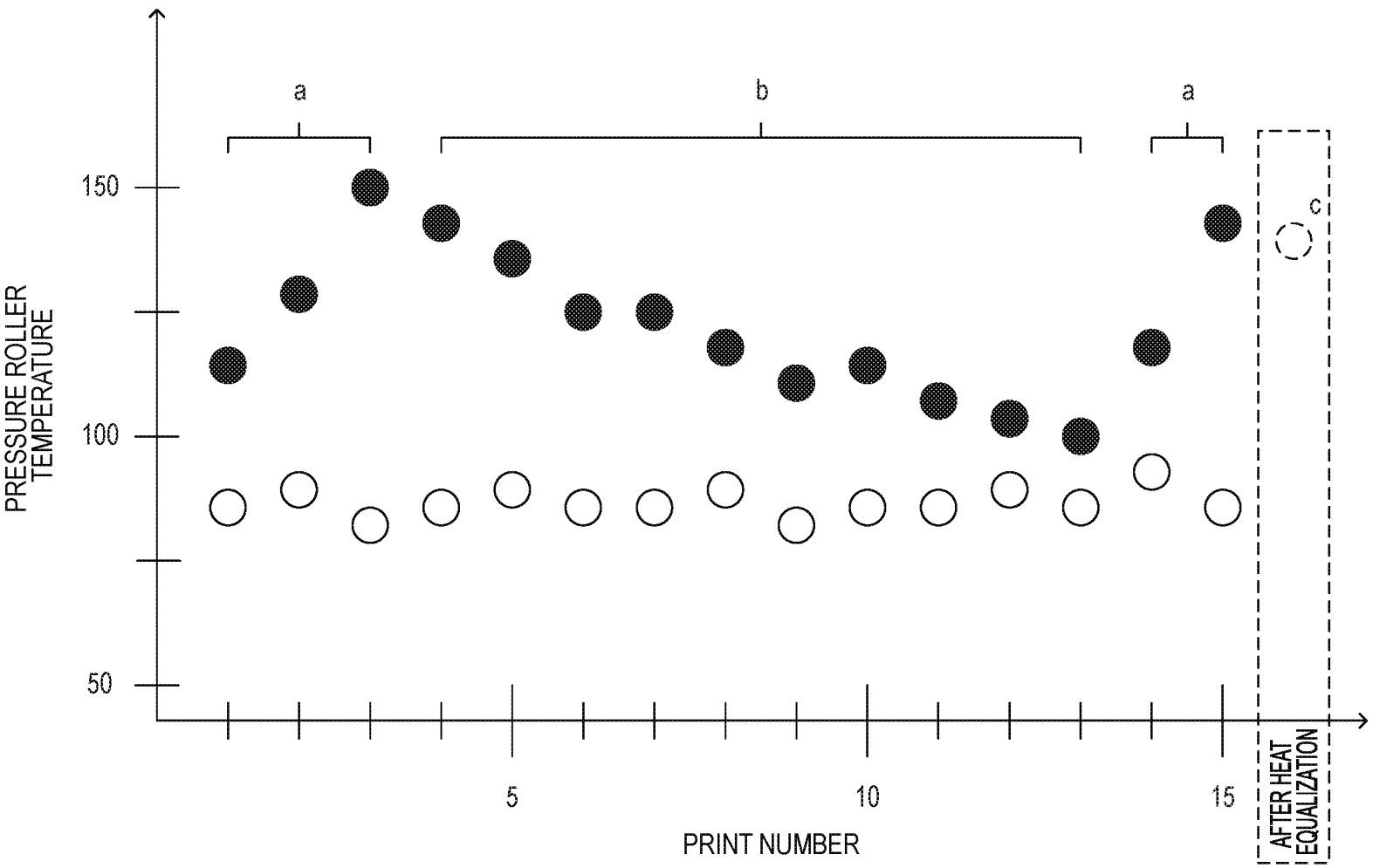
FIG. 8 is a graph illustrating temperature changes of a pressure roller in the first embodiment.

FIG. 8 illustrates changes of the average temperature of the film 51 and the pressure roller 53 in the area A and the areas B in FIG. 6 during continuous printing on 15 small-size sheets. In FIG. 8, the abscissa indicates the number of printed sheets and the ordinate indicates the temperature of the pressure roller 53. In FIG. 8, white circles represent temperatures in the area A (the sheet passing area), and black circles represent temperatures in the areas B (the areas of the non-sheet passing portions). The temperature changes in FIG. 8 were observed in printing in image forming mode for plain paper at a process speed of 100 mm/sec (throughput: 20 sheets per minute) in an environment with a temperature of 23° C. and a humidity of 50%. B5-size sheets with a grammage of 68 g/m$^2$ (CS-680 available from Canon Inc.) were used as the sheets P.

In the sections "a" in FIG. 8, the heat generation member 54*b*1 was used to perform fixing on B5-size sheets P. In the section "b" in FIG. 8, the heat generation member 54*b*2 was used to perform fixing on B5-size sheets P. A white dotted circle labeled with c in FIG. 8 represents the temperature in the area A (the sheet passing area) after the heat equalization operation. In the sections "a," heat was generated with the heat generation member 54*b*1 and therefore the temperature in the edge portions of the pressure roller 53 increased. As described above, the heat generation member 54*b*1 is used for the first 3 sheets or for 3 sheets following 10 printed sheets. The heat generation member 54*b* was then switched to the heat generation member 54*b*2. As shown in the section "b," as more sheets were printed, the temperature in the edge portions of the pressure roller 53 gradually decreased to approach the temperature in the area A (the center portion). When fixing on the 15th sheet P finished, the temperature in the area A (the white circle) was lower than the temperature in the areas B (the black circle). However, after the heat equalization operation, the temperature in the area A (the white dotted circle c) increased to near the temperature in the areas B due to heating by the heat generation member 54*b*2. In this manner, the heat equalization operation increased the temperature in the center portion (the sheet passing portion for small-size sheets) to reduce the longitudinal temperature nonuniformity of the pressure roller 53.

Figure 9:
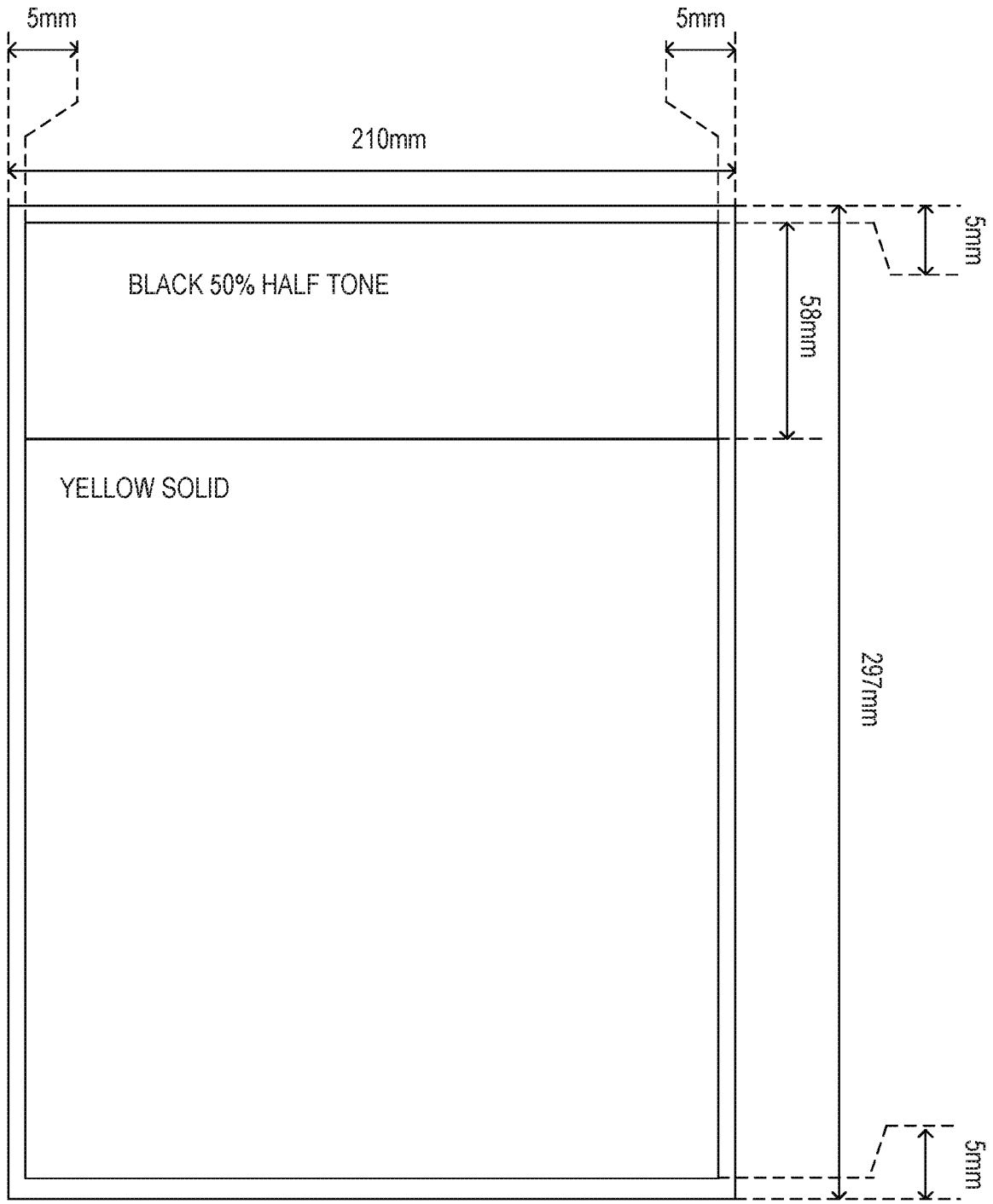
FIG. 9 is a diagram illustrating a print image in the first embodiment.

The above advantageous effect will now be described with reference to the first embodiment and a comparative example. The comparative example uses an image forming apparatus configured as in the first embodiment but performing no heat equalization operation after the completion of printing on small-size sheets. The evaluation was performed as follows. In the first embodiment and the comparative example, printing was performed on a certain number of B5-size sheets with a grammage of 68 g/m$^2$ (CS-680 available from Canon Inc.) immediately followed by one A4-size sheet of the same type. The number of B5-size sheets was varied. As an image to be printed on the B5-size sheets, an image containing characters with a print coverage rate of 5% was used. As an image to be printed on the A4-size sheet, an image as illustrated in FIG. 9 was used. The image in FIG. 9 contains a half-tone image with a density of 50% in a single color of black (Bk) up to 58 mm from the leading edge of the sheet P, followed by a solid image with a print coverage rate of 100% in a single color of yellow (Y). The printing was evaluated and given "x" if a hot offset image appeared in both edge portions (the non-sheet passing portions for the B5-size sheets) in the printed image on the A4-size sheet, and "○" if no hot offset image appeared in the edge portions. Table 2 shows the evaluation result.

TABLE 2

| | NUMBER OF B5-SIZE SHEETS PRINTED | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| COMPARATIVE EXAMPLE | ○ | x | x | x | x | x | x | x | x | ○ | ○ | ○ | ○ | ○ | x | x |
| PRESENT EMBODIMENT | ○ | ○ | ○ | ○ | ○ | ○ | ○ | ○ | ○ | ○ | ○ | ○ | ○ | ○ | ○ | ○ |

With the configuration in the first embodiment, no hot offset image appeared on the A4-size sheet following any number of B5-size sheets printed (1 to 16 sheets). By contrast, with the configuration in the comparative example, a hot offset image appeared in the areas corresponding to the outside of the B5 size on the A4-size sheet following the continuous printing on the 2 to 9, 15, and 16 B5-size sheets.

As described above, in the configuration in which the heat generation member is switched between the multiple heat generation members during continuous printing on small-size sheets, the first embodiment includes performing the heat equalization operation. The heat equalization operation is the operation of reducing the longitudinal temperature nonuniformity of the fixing members resulting after printing on small-size sheets; this is done by causing the heat generation member 54*b*2 to generate heat according to the temperature nonuniformity during the post-rotation after the completion of the printing. That is, in printing on small-size sheets, heat necessary for fixing toner onto the sheets P is supplied and therefore the temperature in the longitudinal center portion of the pressure roller 53 is substantially maintained. On the other hand, for preventing deformation of the film 51, the temperature in the longitudinal edge portions of the pressure roller 53 is controlled to be higher than the temperature in the center portion. In the heat equalization operation after the completion of the printing on the small-size sheets, the longitudinal center portion of the pressure roller 53 is heated by the narrower heat generation member 54*b*2. This makes the temperature in the center portion of the pressure roller 53 closer to the temperature in the edge portions. The edge portions are not heated, so that the temperature in the edge portions decreases due to natural heat dissipation. In this manner, the temperature difference can be reduced between the sheet passing portion and the non-sheet passing portions of the pressure roller 53 and the film 51 immediately after small-size sheets are fed. The occurrences of hot offset can therefore be reduced.

The first embodiment has been described regarding the heat equalization operation in plain paper mode at the highest print speed among the print speeds available with the configuration in the first embodiment. That is, in the first embodiment, the process speed during printing and the operation speed during the heat equalization operation are both 100 mm/s, which is the highest process speed with the configuration in the first embodiment. The heat equalization control can also be applied in low-speed mode in which printing is performed at a speed lower than the highest process speed in order to print on, for example, cardboard. In low-speed mode, the heat equalization operation may be performed at a speed higher than the speed at which printing is performed. This can reduce the time required for the heat equalization operation, thereby preventing a reduction in usability.

The first embodiment has been described regarding switching between the heat generation members 54*b*1 and

Figure 10:
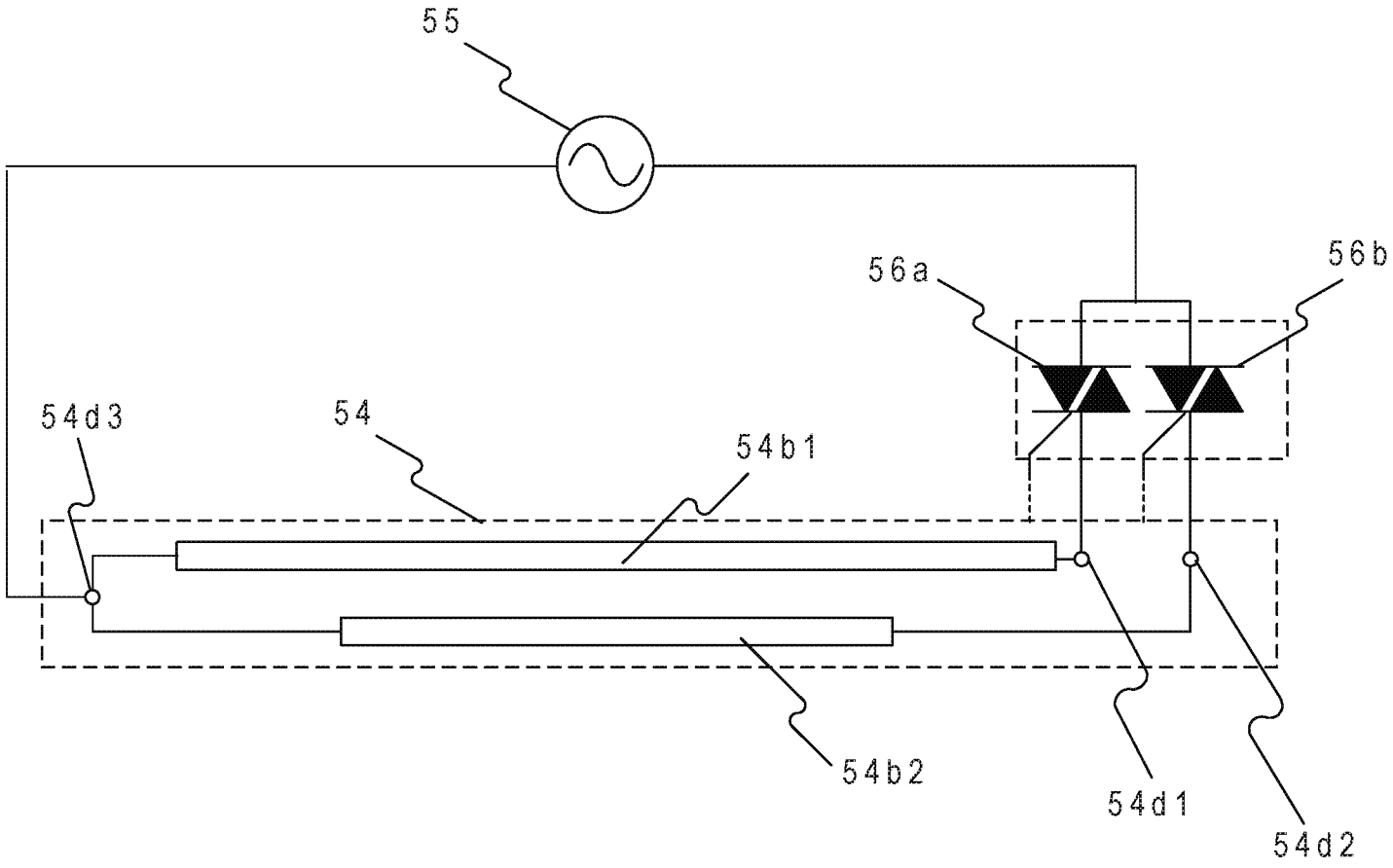
FIG. 10 is a schematic diagram of a power control circuit in the second embodiment.

54*b*2 using the heat generation member switching device 57 that is a Form C contact relay. However, switching between the heat generation members 54*b* is not limited to this manner. For example, as illustrated in FIG. 10, triacs 56*a* and 56*b* may be connected to the respective heat generation members 54*b*1 and 54*b*2 to control the heat generation members 54*b*1 and 54*b*2 independently from each other. In the case of FIG. 10, each of the triacs 56*a* and 56*b* is connected and disconnected to act as a switching device that switches between the heat generation members 54*b*. The first embodiment has also been described regarding determining whether to perform the heat equalization operation and the duration of the heat equalization operation by predicting, from a print history, the degree of temperature increase of the pressure roller 53 in the areas of the non-sheet passing portions for small-size sheets. Alternatively, for example, a temperature detection element may be provided in the non-sheet passing portions for detecting the temperature of the pressure roller 53, the film 51, or the heater 54, in the areas of the non-sheet passing area for small-size sheets. Depending on the detected temperature of the pressure roller 53 in the areas of the non-sheet passing portions, the duration of the heat equalization operation may be determined. The first embodiment has also been described regarding the exemplary image forming apparatus that feeds sheets in a centered manner. However, the image forming apparatus may be configured to feed the sheets P aligned on one side (in a one-side-aligned manner) while printing the sheets P of different sizes.

Thus, according to the first embodiment, the occurrences of image degradation can be reduced by reducing the temperature difference between the sheet passing portion and the non-sheet passing portions in the fixing nip portion.

Second Embodiment

[Power Control Unit]

In the configuration of an image forming apparatus adopted in the second embodiment, the same components as in the first embodiment are labeled with the same symbols and will not be described. In the second embodiment, again, continuous printing on small-size sheets uses the heat generation member 54*b*1 for, e.g., the first three sheets P. In the middle of continuous printing on small-size sheets, fixing is controlled to be performed on, e.g., 10 sheets P with the heat generation member 54*b*2 and then on 3 sheets P with the heat generation member 54*b*1.

In the second embodiment, as illustrated in FIG. 10, the triac 56*a* serving as a first connection unit is connected to the heat generation member 54*b*1, and the triac 56*b* serving as a second connection unit is connected to the heat generation member 54*b*2. The heat generation members 54*b* are thus controlled independently from each other. Compared to using a Form C contact relay to switch between the heat generation members 54*b*, using the triacs 56 as in the second embodiment can reduce the time required for switching between the heat generation members 54*b* to 30 ms. In addition to the heat equalization operation performed during the post-rotation after the completion of print operations as described in the first embodiment, the heat equalization operation in the second embodiment is also performed with the timing as follows. That is, the second embodiment is characterized in that, in printing on small-size sheets with power supplied to the heat generation member 54*b*1, the heat equalization operation is also performed in the sheet interval between a preceding small-size sheet and the following sheet. The two types of heat equalization operations will be distinguished as follows. The heat equalization operation performed during the post-rotation as in the first embodiment will be referred to as a post-rotation heat equalization operation (a first operation). The heat equalization operation performed in sheet intervals as in the second embodiment will be referred to as a sheet-interval heat equalization operation (a second operation).

[Switching between Heat Generation Members during Sheet-Interval Heat Equalization Operation]

Figure 11A:
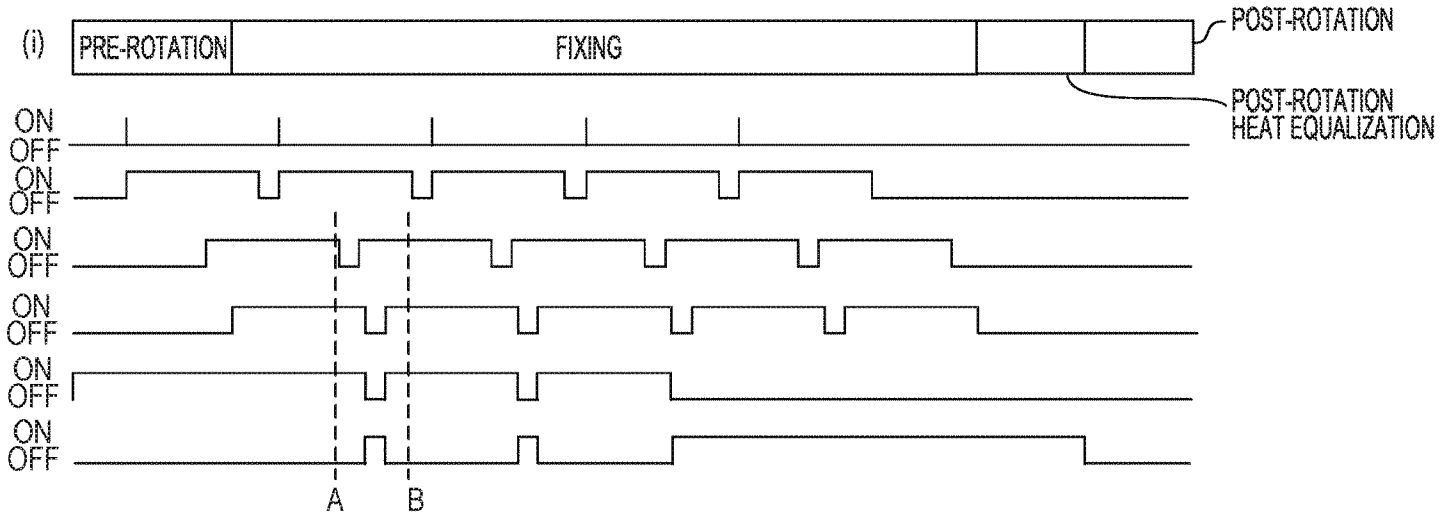
FIGS. 11A and 11B are timing charts of a sheet-interval heat equalization operation in the second embodiment.

Details of the operation of switching between the heat generation members for the sheet-interval heat equalization operation in the second embodiment will be described with reference to FIGS. 11A and 11B. FIG. 11A is a timing chart of continuous printing on five B5 small-size sheets used as the sheets P. In FIG. 11A, (i) illustrates operations of the fixing apparatus 50 (pre-rotation, fixing, post-rotation heat equalization, and post-rotation). (ii) illustrates a TOP signal (ON, OFF) serving as the reference for the timing of image forming operations. (iii) illustrates the timing of image forming. ON indicates that an image is being formed, and OFF indicates that no image is being formed. (iv) illustrates an output signal of the registration sensor 103. A high-level signal (ON) is output when a sheet P is detected, and a low-level signal (OFF) is output when no sheet is detected. (v) illustrates the presence or absence of a sheet P in the fixing nip portion. ON indicates that a sheet P is being subjected to fixing while being held by the fixing nip portion and conveyed, and OFF indicates that no sheet P exists and fixing is not being performed. (vi) and (vii) indicate whether the respective triacs 56*a* and 56*b* are in conduction (ON) (connected) or out of conduction (OFF) (disconnected). That is, the triacs 56 being ON indicate that power is supplied to the respective heat generation members 54*b*.

Figure 11B:
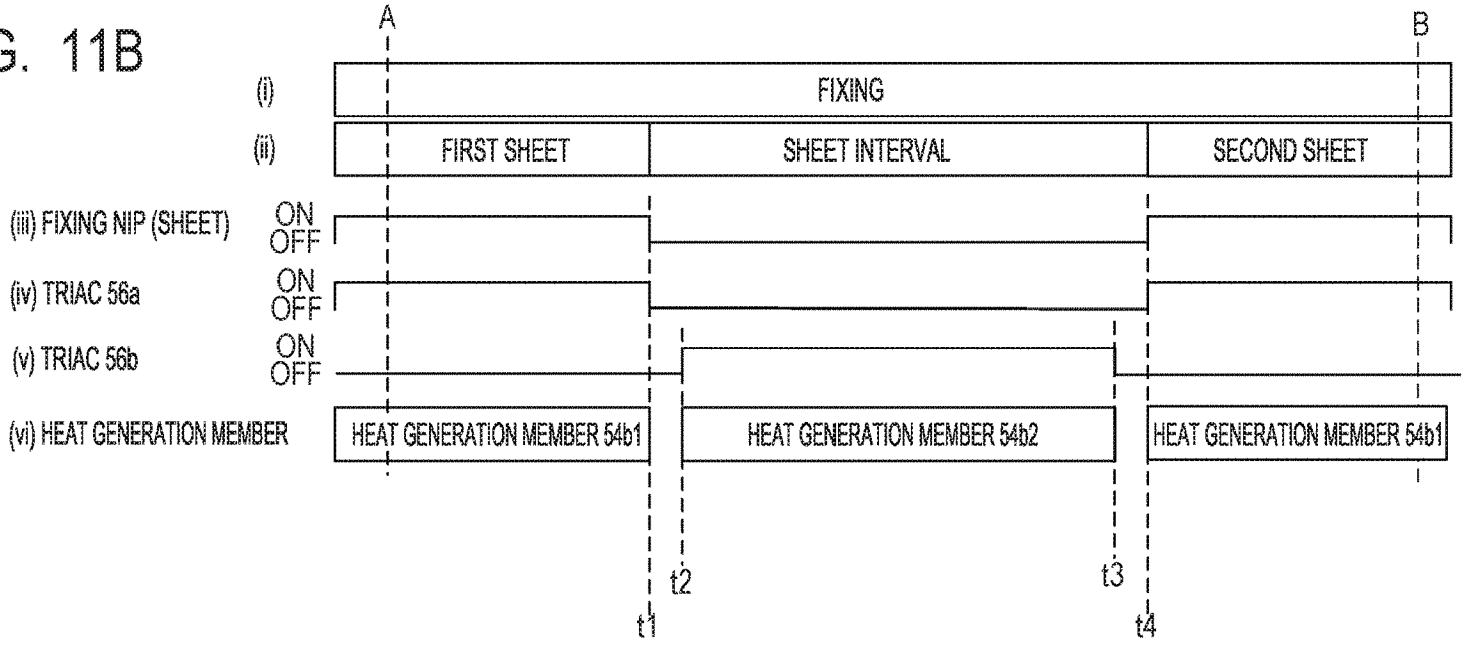

FIG. 11B is a detailed timing chart of the operation of switching between the heat generation members 54*b* and enlarges the A-B section in FIG. 11A. In FIG. 11B, (i) corresponds to (i) in FIG. 11A. (ii) illustrates the sequential sheets (the first and the second) and the sheet interval. (iii) illustrates the state of the fixing nip portion (sheet), so that the ON state indicates that a sheet P is being held by the fixing nip portion N and conveyed, and the OFF state indicates that no sheet P exists. (iv) and (v) in FIG. 11B correspond to (vi) and (vii) in FIG. 11A, respectively. (vi) illustrates the heat generation member 54*b* being selected. In the second embodiment, after the completion of fixing on a small-size sheet with the heat generation member 54*b*1, the heat generation member 54*b* is switched from the heat generation member 54*b*1 to the heat generation member 54*b*2, which then generates heat in the sheet interval up to the following sheet.

In the second embodiment, the CPU 94 causes the triac 56*a* to cut off the power supply to the heat generation member 54*b*1 at time t1. Time t1 is a timepoint after the trailing edge of the first sheet P reaches the most downstream position in the conveyance direction in the fixing nip portion N (hereinafter referred to as the most downstream position). The CPU 94 determines time t1 with reference to the TOP signal. Although in the second embodiment the triac 56*a* cuts off the power at time t1 after the arrival of the trailing edge of the first sheet P at the most downstream position in the fixing nip portion N, the cutoff and the arrival may be simultaneous.

At time t2, which is 30 ms after time t1, the CPU 94 causes the triac 56*b* to start power supply to the heat generation member 54*b*2. At time t3, the CPU 94 causes the triac 56*b* to cut off the power supply to the heat generation member 54*b*2. Time t3 is 30 ms before the sheet interval ends and the leading edge of the second sheet P reaches the most upstream position in the conveyance direction in the fixing nip portion N (hereinafter referred to as the most upstream position). At time t4, the CPU 94 causes the triac 56*a* to supply power to the heat generation member 54*b*1. Time t4 is when the leading edge of the second sheet P reaches the most upstream position in the fixing nip portion N.

In this manner, for the first three sheets after the start of the printing, power is supplied to the heat generation member 54*b*1 while the sheets are being fed (during the fixing operation), whereas power is supplied to the heat generation member 54*b*2 in the sheet intervals. For the fourth and fifth sheets, power is supplied to the heat generation member 54*b*2 both during the fixing operation and in the sheet interval. After the completion of the fixing operation on the fifth sheet, the post-rotation heat equalization operation is performed according to the edge thermal index WI to be described below. The configuration in FIGS. 11A and 11B has been described regarding the sheet-interval heat equalization operation during the fixing that uses the heat generation member 54*b*1 for the first three sheets. For continuous printing on more sheets, the sheet-interval heat equalization operation in sheet intervals with the heat generation member 54*b*2 is similarly performed during fixing with the heat generation member 54*b*1 in the middle of the continuous printing (S122 to S127 NO in FIG. 5). Alternatively, the sheet-interval heat equalization operation may be performed at least either in the beginning of the continuous printing for the first three sheets, or in the continuous printing for sheets after the first three sheets.

[Post-Rotation Heat Equalization Operation]

As in the first embodiment, the duration of the post-rotation heat equalization operation in the second embodiment is determined by predicting how much the temperature of the pressure roller 53 increases in the areas of the non-sheet passing portions for small-size sheets from the number of printed sheets. In the second embodiment, during continuous printing on small-size sheets, 10 is added to the edge thermal index WI each time a small-size sheet is fed while the heat generation member 54*b*1 is selected. For each subsequent sheet interval in which the heat generation member 54*b* is switched from the heat generation member 54*b*1 to the heat generation member 54*b*2, 3 is subtracted from the edge thermal index WI. Also, 3 is subtracted from the edge thermal index WI each time a sheet P is fed while the heat generation member 54*b*2 is selected. Upon completion of the fixing operation on a specified number of small-size sheets, the CPU 94 performs the post-rotation heat equalization operation for a period illustrated in Table 3 according to the counted edge thermal index WI. After the post-rotation heat equalization operation, the edge thermal index WI is cleared to 0. During the post-rotation heat equalization operation, the CPU 94 controls the temperature so that the fixing temperature sensor 59 senses 150° C. In print operations immediately after the post-rotation heat equalization operation, the CPU 94 reduces the target temperature for the control, as shown in FIG. 3, from the temperature that would be the target in the absence of the post-rotation heat equalization operation.

TABLE 3

| | EDGE THERMAL INDEX | | |
|---|---|---|---|
| | 1-10 | 11-20 | 21-30 |
| HEAT EQUALIZATION TIME (SEC) | 0 | 0.65 | 1.3 |
| CORRECTION TEMPERATURE AFTER HEAT EQUALIZATION (° C.) | 0 | −3 | −6 |

Table 3 illustrates the edge thermal index, the heat equalization time (sec), and the correction temperature after heat equalization (° C.). In Table 3, as in Table 1, as the edge thermal index WI increases, the heat equalization time is set to be longer and the range of reduction of the correction temperature after heat equalization is increased. The second embodiment includes the sheet-interval heat equalization operation performed during fixing with the heat generation member 54*b*1. The temperature difference between the area A and the areas B in FIG. 6 at the completion of printing operations is accordingly smaller than the temperature difference in the absence of the sheet-interval heat equalization operation. Therefore, for a certain edge thermal index, the heat equalization time is shorter and the range of reduction of the correction temperature after heat equalization is narrower than in Table 2.

As described above, in the configuration in which the heat generation member 54*b* is switched between the multiple heat generation members 54*b* during continuous printing on small-size sheets, the second embodiment includes performing the heat equalization operation in sheet intervals as well. The sheet-interval heat equalization operation is performed by switching the heat generation member 54*b* to the heat generation member 54*b*2 in the sheet interval between a small-size sheet and the following sheet. In this manner, the temperature difference can be reduced between the sheet passing portion and the non-sheet passing portions of the pressure roller 53 and the film 51 immediately after small-size sheets are fed. The occurrences of hot offset on the following sheets caused by the hot non-sheet passing portions can therefore be reduced. In addition, performing the sheet-interval heat equalization operation in sheet intervals can reduce the time required for the post-rotation heat equalization operation after the completion of printing.

Thus, according to the second embodiment, the occurrences of image degradation can be reduced by reducing the temperature difference between the sheet passing portion and the non-sheet passing portions in the fixing nip portion.

Third Embodiment

In the configuration of an image forming apparatus adopted in the third embodiment, the same components as in the first embodiment are labeled with the same symbols and will not be described. The third embodiment is characterized in that, in the heat equalization operation during the post-rotation after the completion of print operations as described in the first embodiment, the set temperature T used for the temperature control in the heat equalization operation is changed according to the edge thermal index WI obtained after the completion of the printing on the small-size sheets.

The temperature control in the heat equalization operation is determined by predicting how much the temperature of the pressure roller 53 increases in the areas of the non-sheet passing portions for small-size sheets from the number of printed sheets. Specifically, the degree of temperature increase of the pressure roller 53 in the areas of the non-sheet passing portions for small-size sheets is represented as the edge thermal index WI. Based on the edge thermal index WI, the set temperature T in the heat equalization operation is determined. The heat equalization operation is performed for a period corresponding to one rotation of the pressure roller 53 (for example, 0.65 seconds).

[Counting Edge Thermal Index]

Figure 12:
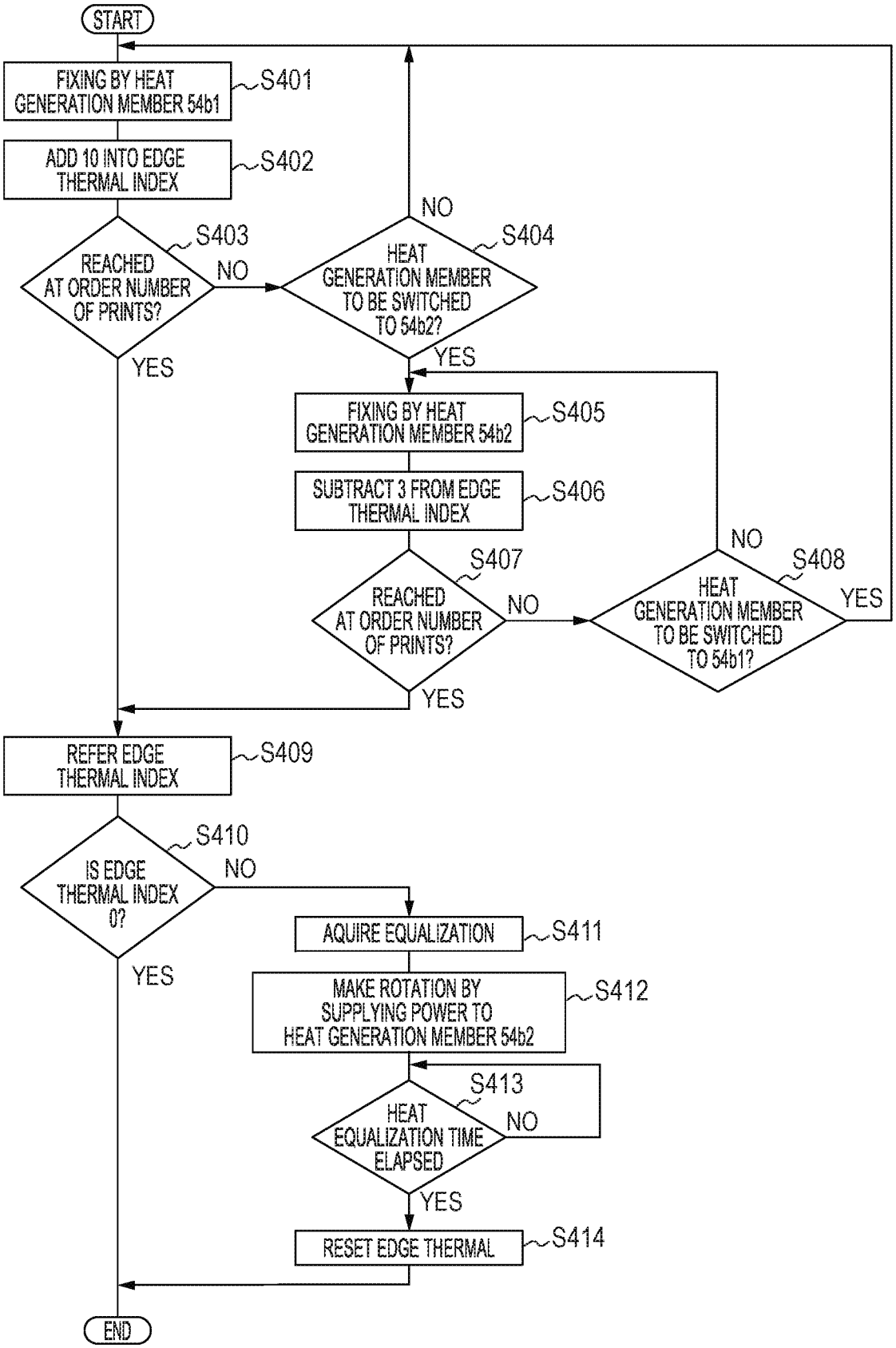
FIG. 12 is a flowchart of heat equalization control in the third embodiment.

The method of counting the edge thermal index WI in printing on small-size sheets in the third embodiment will be described with reference to FIG. 12. The processing at S401 to S410 in FIG. 12 is the same as the processing at S301 to S310 in FIG. 7 and therefore will not be described. In the third embodiment, again, the CPU 94 adds 10 to the edge thermal index each time a small-size sheet is fed while the heat generation member 54*b*1 is selected to be powered during continuous printing on small-size sheets (S402). As the continuous printing on small-size sheets proceeds, the CPU 94 switches the heat generation member 54*b* from the heat generation member 54*b*1 to the heat generation member 54*b*2. Thereafter, the CPU 94 subtracts 3 from the edge thermal index WI each time a small-size sheet is fed while the heat generation member 54*b*2 is selected (S406).

If the edge thermal index WI is not 0, at S411, the CPU 94 acquires the heat equalization temperature (the set temperature T), which is a certain temperature, based on the edge thermal index WI and Table 4. At S412, the CPU 94 causes the triac 56 to supply power to the heat generation member 54*b*2, rotates the pressure roller 53, and resets and starts the timer (not shown). Here, the CPU 94 performs the heat equalization operation, in which, while idling the pressure roller 53, the CPU 94 controls the temperature so that the fixing temperature sensor 59 senses the heat equalization temperature (the set temperature T) acquired at S411.

At S413, the CPU 94 refers to the timer to determine whether the heat equalization time has elapsed. In the third embodiment, the heat equalization time, which is a certain period, is the period corresponding to one rotation of the pressure roller 53 (a fixed period (for example, 0.65 seconds)). If the CPU 94 determines that the heat equalization time has not elapsed at S413, the process returns to S413. If the CPU 94 determines that the heat equalization time has elapsed at S413, the process proceeds to S414. At S414, the CPU 94 resets (clears) the edge thermal index WI to 0 and terminates the process. As in the first embodiment, in print operations immediately after the heat equalization operation, the CPU 94 refers to the correction temperature after heat equalization and reduces the temperature used in the temperature control according to the edge thermal index WI.

TABLE 4

| | EDGE THERMAL INDEX | | | |
|---|---|---|---|---|
| | 1-5 | 6-10 | 11-20 | 21-30 |
| HEAT EQUALIZATION TEMPERATURE (° C.) | 150 | 160 | 170 | 180 |

Table 4 illustrates the edge thermal index and the heat equalization temperature (° C.). For example, assume that counting the edge thermal index WI results in an edge thermal index WI of 7. The CPU 94 then refers to Table 4 to acquire 160° C. as the heat equalization temperature. As shown in Table 4, as the edge thermal index WI increases, the area A in FIG. 5 is colder relative to the temperature in the areas B and therefore the heat equalization temperature is set to be higher.

As described above, in the configuration in which the heat generation member 54*b* is switched between the multiple heat generation members 54*b* during continuous printing on small-size sheets, the third embodiment includes performing the heat equalization operation. The heat equalization operation reduces the longitudinal temperature nonuniformity by causing the heat generation member 54*b*2 to generate heat during the post-rotation. Further, the set temperature T for the temperature control during the heat equalization operation is changed according to the degree of the temperature nonuniformity of the fixing members. In this manner, the temperature difference can be reduced, in a short time, between the sheet passing portion and the non-sheet passing portions of the pressure roller 53 and the film 51 immediately after the small-size sheets are fed. The occurrences of hot offset can therefore be reduced.

Thus, according to the third embodiment, the occurrences of image degradation can be reduced by reducing the temperature difference between the sheet passing portion and the non-sheet passing portions in the fixing nip portion.

Fourth Embodiment

Figure 13A:
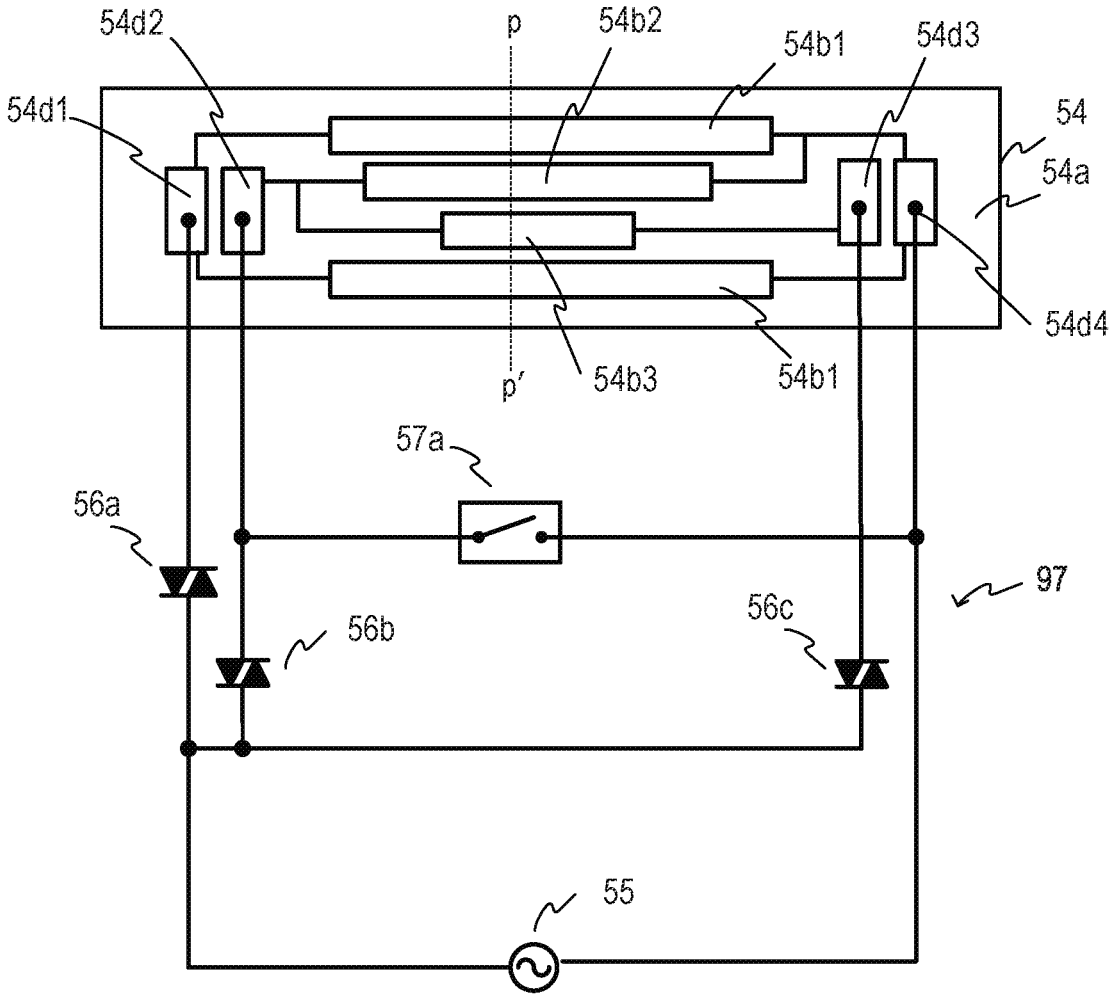
FIGS. 13A and 13B are schematic diagrams of a heater having three types of heat generation members 54*b* in a fourth embodiment.
Figure 13B:
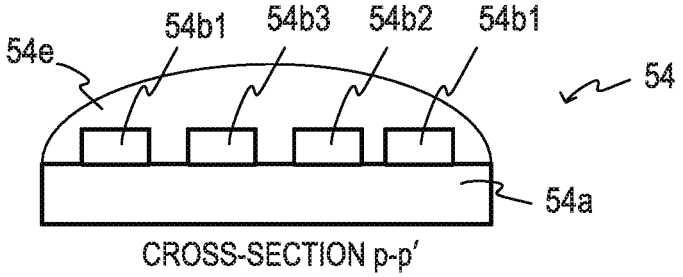

Further, the lengths and the number of the heat generation members 54*b* are not limited to the values described in the above embodiments. For example, as illustrated in FIGS. 13A and 13B, the heater 54 may include two heat generation members 54*b*1, one heat generation member 54*b*2, and one heat generation member 54*b*3 of three different lengths. For example, the length of the heat generation members 54*b*1, the length of the heat generation member 54*b*2, and the length of the heat generation member 54*b*3 are set to be several millimeters longer than the letter-size width 215.9 mm, the B5-size width 182 mm, and the A5-size width 148 mm, respectively. Providing multiple heat generation members 54*b* in this manner allows accommodating sheets of a wider variety of sizes.

Figure 14A:
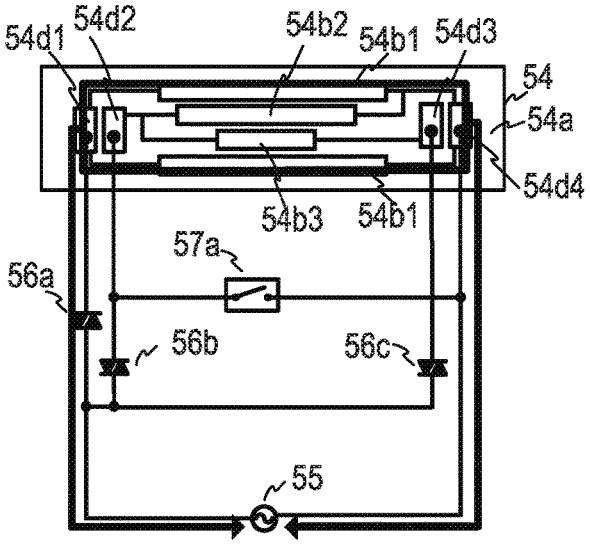
FIGS. 14A, 14B and 14C are schematic diagrams illustrating three current paths for the three types of heat generation members 54*b* in the fourth embodiment.
Figure 14B:
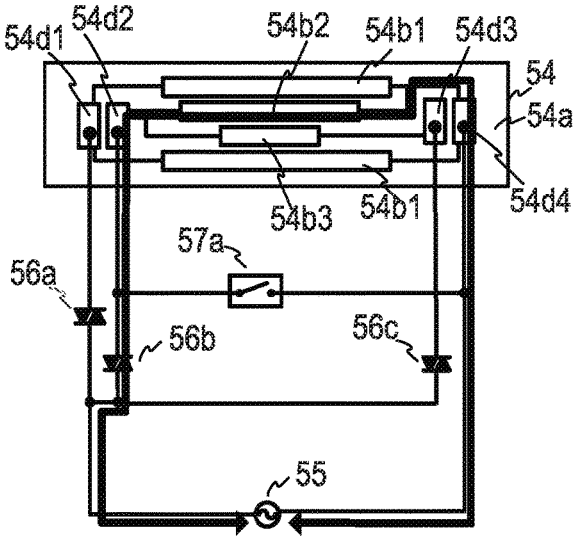
Figure 14C:
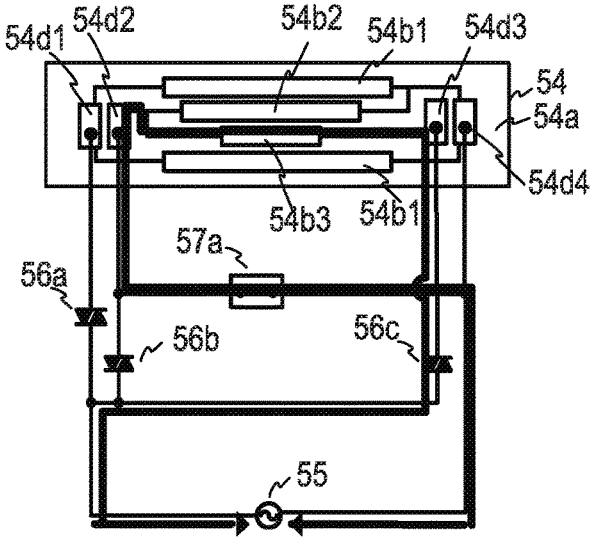

Methods will now be described for energization by alternately switching between the heat generation member 54*b*2 and the heat generation members 54*b*1, and between the heat generation member 54*b*3 and the heat generation members 54*b*1. FIGS. 14A to 14C illustrate the heater 54 including the heat generation members 54*b*1, 54*b*2 and 54*b*3 of three lengths, and three current paths (which are electric paths and also power supply paths) to the heat generation members 54*b*1 to 54*b*3. The current paths shown in FIGS. 14A to 14C are merely exemplary and other current paths are also possible.

(Power Supply to Heat Generation Members 54*b*1)

When power is supplied from the AC power supply 55 to the heat generation members 54*b*1, current flows through a route indicated by a bold line in FIG. 14A. A temperature detection element such as a thermistor (not shown) detects the temperature of the heater 54. Based on the detected temperature information, the triac 56*a* operates under instructions from a microcomputer (not shown), so that the heat generation members 54*b*1 are controlled to be at a certain temperature. Power supply to the heat generation members 54*b*1 does not rely on the triacs 56*b* and 56*c* nor an electromagnetic relay 57*a* of Form A contact configuration. That is, for supplying power to the heat generation members 54*b*1, the heat generation member switching device 57*a* may be open or short-circuited. In FIG. 14A, the heat generation member switching device 57*a* is shown as being open by way of example.

(Power Supply to Heat Generation Member 54*b*2)

When power is supplied from the AC power supply 55 to the heat generation member 54*b*2, current flows through a route indicated by a bold line in FIG. 14B. For supplying power to the heat generation member 54*b*2, the contact of the heat generation member switching device 57*a* of Form A contact configuration is set to be in the open state. The contact impedance of the open heat generation member switching device 57*a* of Form A contact configuration is sufficiently larger than that of the heat generation member 54*b*2. Therefore, substantially no current flows to the heat generation member switching device 57*a* of Form A contact configuration, and this allows only the heat generation member 54*b*2 to generate heat. The power supplied to the heat generation member 54*b*2 is controlled by the triac 56*b*.

(Power Supply to Heat Generation Member 54*b*3)

When power is supplied from the AC power supply 55 to the heat generation member 54*b*3, current flows through a route indicated by a bold line in FIG. 14C. For supplying power to the heat generation member 54*b*3, the contact of the heat generation member switching device 57*a* of Form A contact configuration is set to be in the short-circuited state. This causes substantially all the current to flow to the heat generation member 54*b*3. The contact impedance of the short-circuited heat generation member switching device 57*a* of Form A contact configuration is sufficiently smaller than that of the heat generation member 54*b*2. Therefore, substantially no current flows to the heat generation member 54*b*2, and this allows only the heat generation member 54*b*3 to generate heat. The power supplied to the heat generation member 54*b*3 is controlled by the triac 56*c*.

[Switching of Power Supply Path]

For switching between the power supply path to the heat generation members 54*b*1 (FIG. 14A) and the power supply path to the heat generation member 54*b*2 (FIG. 14B), the contact of the heat generation member switching device 57*a* of Form A contact configuration is set to be in the open state in advance. The switching may then be independently controlled only with the contactless switches of the triacs 56*a* and 56*b*. This allows seamless state transitions between the power supply path (FIG. 14A) and the power supply path (FIG. 14B), and the simultaneous use of the power supply path (FIG. 14A) and the power supply path (FIG. 14B).

Similarly, switching can be performed between the power supply path to the heat generation members 54*b*1 (FIG. 14A) and the power supply path to the heat generation member 54*b*3 (FIG. 14C). As described above, in the power supply path (FIG. 14A), the heat generation member switching device 57*a* may be open or short-circuited. Setting the contact of the heat generation member switching device 57*a* of Form A contact configuration to be in the short-circuited state in advance allows seamless state transitions between the power supply path (FIG. 14A) and the power supply path (FIG. 14C), and the simultaneous use of the power supply path (FIG. 14A) and the power supply path (FIG. 14C).

For switching between the power supply path to the heat generation member 54*b*2 (FIG. 14B) and the power supply path to the heat generation member 54*b*3 (FIG. 14C), the state of the heat generation member switching device 57*a* of Form A contact configuration must be switched. This hinders the simultaneous use of the power supply path (FIG. 14B) and the power supply path (FIG. 14C). That is, the power supply path (FIG. 14B) and the power supply path (FIG. 14C) are mutually exclusive and only one of them can be used.

If switching between the power supply path (FIG. 14B) and the power supply path (FIG. 14C) is desired, the following ways may be taken. For example, the state may be transitioned in the following order: the power supply path (FIG. 14B)→the power supply path (FIG. 14A)→the power supply path (FIG. 14C), or the power supply path (FIG. 14C)→the power supply path (FIG. 14A)→the power supply path (FIG. 14B). In either case, the power supply path (FIG. 14A) may intervene between the power supply path (FIG. 14B) and the power supply path (FIG. 14C). While the power supply path (FIG. 14A) is being used, the heat generation member switching device 57*a* of Form A contact configuration may be switched from the open state to the short-circuited state, or from the short-circuited state to the open state. This can prevent such a situation that power supply to the heater 54 is cut off in order to wait until the state of the contact of the heat generation member switching device 57*a* of Form A contact configuration is stabilized, resulting in failure to supply an amount of heat necessary for the sheets P.

The heat generation member switching device 57*a* has been described by way of example as an electromagnetic relay of Form A contact configuration. However, this is not limiting. The heat generation member switching device 57*a* may be a contact switch such as an electromagnetic relay of Form B contact configuration or Form C contact configuration. Further, the heat generation member switching device 57*a* may be a contactless switch such as a solid-state relay (SSR), photoMOS relay, or triac.

According to the present invention, the occurrences of image degradation can be reduced by reducing the temperature difference between the sheet passing portion and the non-sheet passing portions in the fixing nip portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-019912, filed Feb. 6, 2019, which is hereby incorporated by reference herein in its entirety.

What is claimed is:

1. A fixing apparatus comprising:

a first heat generation member configured to fix an image on a first recording material or a second recording material, a length of the second recording material in a longitudinal direction, which is a direction orthogonal to a conveying direction of the first or second recording material, being shorter than a length in the longitudinal direction of the first recording material;

a second heat generation member whose length in the longitudinal direction is shorter than a length in the longitudinal direction of the first heat generation member, the second heat generation member configured to fix an image on the second recording material;

a first rotary member configured to be heated by the first heat generation member or the second heat generation member;

a second rotary member configured to form a nip portion together with the first rotary member; and a control unit configured to, in a case of continuous printing on a plurality of sheets of the second recording material, perform control to switch, at a predetermined frequency, between using the first heat generation member to perform fixing and not using the first heat generation member to perform fixing, wherein in a state where the first rotary member and the second rotary member rotate after completion of printing on the plurality of sheets of the second recording material, the control unit performs a first operation in which the second heat generation member generates heat, and wherein in the first operation, the second heat generation generates heat in a state in which no recording material is in the nip portion.

2. A fixing apparatus according to claim 1, wherein a time period during which the second heat generation member generates heat in the first operation is determined based on an amount of temperature increase of an edge in the longitudinal direction of the nip portion due to use of the first heat generation member and the second heat generation member in fixing performed on the plurality of sheets of the second recording material.

3. A fixing apparatus according to claim 2, wherein the time period during which the second heat generation member generates heat in the first operation is determined so that the time period during which the second heat generation member generates heat in the first operation increases as the amount of temperature increase of the edge increases.

4. A fixing apparatus according to claim 2, wherein the control unit controls the second heat generation member to generate heat in the first operation at a fixed temperature.

5. A fixing apparatus according to claim 1, wherein after performing the first operation, the control unit performs control to reduce a target temperature in the nip portion, wherein the amount of reduction of the target temperature increases as the time period during which the second heat generation member generates heat in the first operation increases.

6. A fixing apparatus according to claim 1, wherein in fixing on the plurality of sheets of the second recording material, a target temperature for the second heat generation member for the time period during which the second heat generation member generates heat in the first operation is determined based on an amount of temperature increase of an edge in the longitudinal direction of the nip portion due to use of the first heat generation member and the second heat generation member.

7. A fixing apparatus according to claim 6, wherein the target temperature for the second heat generation member for the time period during which the second heat generation member generates heat in the first operation is determined so that the target temperature increases as the amount of temperature increase of the edge increases.

8. A fixing apparatus according to claim 6, wherein the time period during which the second heat generation member generates heat in the first operation is a time period corresponding to one rotation of the second rotary member.

9. A fixing apparatus according to claim 1, wherein in fixing on the plurality of sheets of the second recording material, the control unit performs the fixing with the first heat generation member on a predetermined number of sheets of the second recording material from start of the fixing.

10. A fixing apparatus according to claim 1, wherein in fixing on the second recording material by the first heat generation member, the control unit performs a second operation in which the second heat generation member generates heat in a sheet interval between a trailing edge of a preceding sheet and a leading edge of a following sheet on which fixing is continuously performed on the preceding sheet.

11. A fixing apparatus according to claim 10, comprising:

a first connection unit configured to be in a connection state when supplying power to the first heat generation member, and to be in a disconnection state when cutting off power supply to the first heat generation member; and a second connection unit configured to be in a connection state when supplying power to the second heat generation member, and to be in a disconnection state when cutting off power supply to the second heat generation member.

12. A fixing apparatus according to claim 11, wherein the first connection unit and the second connection unit are bidirectional thyristors.

13. A fixing apparatus according to claim 1, comprising:

a connection unit configured to be in a connection state when supplying power to the first heat generation member or the second heat generation member, and to be in a disconnection state when cutting off power supply to the first heat generation member or the second heat generation member; and a switching unit configured to switch a power supply path for supplying power to the first heat generation member or the second heat generation member, wherein the control unit performs control so that the power supply path is switched by the switching unit after the connection unit is in the disconnection state, and after the power supply path is switched by the switching unit the connection unit is controlled to be in the connection state.

14. A fixing apparatus according to claim 13, wherein after completion of printing on the plurality of sheets of the second recording material, the control unit switches to the first heat generation member by causing the switching unit to switch the power supply path.

15. A fixing apparatus according to claim 1, wherein the first rotary member is a film.

16. A fixing apparatus according to claim 15, wherein the fixing apparatus comprises a heater including a substrate on which the first heat generation member and the second heat generation member are provided, and wherein the nip portion is formed by the heater and by the second rotary member, through the film.

17. An image forming apparatus comprising:

an image forming unit configured to form an unfixed toner image on a recording material; and a fixing apparatus according to claim 1, configured to fix the unfixed toner image on the recording material.

18. A fixing apparatus comprising:

a first heat generation member configured to fix an image on a first recording material or a second recording material, a length of the second recording material in a longitudinal direction, which is a direction orthogonal to a conveying direction of the first or second recording material, being shorter than a length of the first recording material in the longitudinal direction;

a second heat generation member whose length in the longitudinal direction is shorter than a length in the longitudinal direction of the first heat generation member, the second heat generation member configured to fix an image on the second recording material;

a first rotary member configured to be heated by the first heat generation member or the second heat generation member;

a second rotary member configured to form a nip portion together with the first rotary member; and a control unit configured to, in a case of continuous printing on a plurality of sheets of the second recording material, perform control to switch, at a predetermined frequency, between using the first heat generation member to perform fixing and not using the first heat generation member to perform fixing, wherein in a state where the first rotary member and the second rotary member rotate after completion of printing on the plurality of sheets of the second recording material, and where no recording material is present in the nip portion, the control unit controls a heat generation amount at a center portion of the nip portion in the longitudinal direction to be larger than a heat generation amount at an edge portion of the nip portion in the longitudinal direction.

19. A fixing apparatus according to claim 18, wherein the first rotary member is a film.

20. A fixing apparatus according to claim 19, wherein the fixing apparatus comprises a heater including a substrate on which the first heat generation member and the second heat generation member are provided, and wherein the nip portion is formed by the heater and by the second rotary member, through the film.

* * * * *